US010978256B1

(12) United States Patent
Schafer

(10) Patent No.: US 10,978,256 B1
(45) Date of Patent: Apr. 13, 2021

(54) ELECTRICAL SWITCHING DEVICE

(71) Applicant: Innovative Switchgear IP, LLC, Dacono, CO (US)

(72) Inventor: Roger L. Schafer, Dacono, CO (US)

(73) Assignee: Innovative Switchgear IP, LLC, Dacono, CO (US)

( * ) Notice: Subject to any disclaimer, the term of this patent is extended or adjusted under 35 U.S.C. 154(b) by 0 days.

(21) Appl. No.: 14/218,541

(22) Filed: Mar. 18, 2014

Related U.S. Application Data

(60) Provisional application No. 61/793,880, filed on Mar. 15, 2013.

(51) Int. Cl.
*H01H 33/02* (2006.01)
*H01H 9/00* (2006.01)
*H01H 9/02* (2006.01)

(52) U.S. Cl.
CPC ..... *H01H 9/0072* (2013.01); *H01H 33/022* (2013.01); *H01H 2009/0292* (2013.01)

(58) Field of Classification Search
CPC ..... H01H 2009/0292; H01H 50/06; H01H 9/0072; H01H 33/022
See application file for complete search history.

(56) References Cited

U.S. PATENT DOCUMENTS

| | | | |
|---|---|---|---|
| 2,452,947 | A | 11/1945 | Meyerhans |
| 2,532,529 | A | 1/1948 | Amer |
| 2,696,540 | A | 12/1954 | Christensen |
| 3,472,981 | A | 10/1969 | McCarty et al. |
| 3,671,907 | A | 6/1972 | Brunner |
| 3,735,019 | A | 5/1973 | Hess et al. |
| 3,869,192 | A | 3/1975 | Maier et al. |
| 3,919,509 | A | 11/1975 | Schnitzius |
| 4,000,388 | A | 12/1976 | Carter |
| 4,105,878 | A | 8/1978 | Date et al. |
| 4,216,359 | A | 8/1980 | Hruda |
| 4,220,837 | A | 9/1980 | Bice |

(Continued)

FOREIGN PATENT DOCUMENTS

| | | | |
|---|---|---|---|
| CN | 201408929 | Y | 2/2010 |
| DE | 9319264 | U1 | 3/1994 |

(Continued)

OTHER PUBLICATIONS

ABB Patent Gmbh, "Driving connection between two linearly movable in its longitudinal direction components", Notification date Jan. 2, 2018, Translation DE9319264 U1 (Original Doc. published Mar. 2, 1994), 4 pages.

*Primary Examiner* — Felix O Figueroa
(74) *Attorney, Agent, or Firm* — DiBerardino McGovern IP Group LLC

(57) ABSTRACT

In accordance with certain embodiments, an improved switching mechanism and related components are provided. In accordance with one embodiment, an apparatus can include a switching mechanism rated to switch at least 27 kilovolts; a housing to house the switching mechanism; an isolation point of the switching mechanism visible from outside the housing to visibly exhibit a physical open-circuit by the switching mechanism; wherein the isolation point is electrically insulated without using $SF_6$ gas during operation. This abstract is not intended to be used to determine the scope of this patent.

43 Claims, 23 Drawing Sheets

(56) References Cited

U.S. PATENT DOCUMENTS 4,283,610 A 8/1981 Date et al.
4,328,430 A * 5/1982 Efinger ..... H01H 3/26 318/139
4,343,030 A 8/1982 Date et al.
4,450,327 A 5/1984 Yanagisawa et al.
4,484,046 A 11/1984 Neuhouser
4,528,432 A 7/1985 Senba et al.
4,568,804 A 2/1986 Luehring
4,587,390 A 5/1986 Gray
4,672,156 A 6/1987 Basnett
4,871,888 A 10/1989 Bestel
4,910,367 A * 3/1990 Akers ..... H01H 33/56 218/57
5,062,022 A * 10/1991 Beard ..... H02B 7/00 361/605
5,436,414 A 7/1995 Hodkin
5,521,348 A 5/1996 Berndt et al.
5,521,567 A 5/1996 Devonald, III et al.
5,594,223 A 1/1997 Fukushi et al.
5,597,992 A 1/1997 Walker
5,644,117 A 1/1997 Bolongeat-Mobleu et al.
5,625,277 A * 4/1997 Khan ..... H02J 3/1807 322/58
5,808,258 A 1/1998 Luzzi
5,847,347 A 12/1998 Schwarze et al.
5,864,107 A * 1/1999 French ..... G01R 29/18 200/50.01
5,864,108 A 1/1999 Röhling et al.
5,917,167 A 6/1999 Bestel
5,929,411 A 7/1999 Schulman
6,046,422 A 4/2000 Gessner
6,107,592 A 8/2000 Morita et al.
6,141,192 A 10/2000 Garzon
6,310,310 B1 10/2001 Wristen
6,410,875 B2 6/2002 Allard et al.
6,587,021 B1 * 7/2003 Streeter ..... H01H 1/0036 200/181
6,628,494 B2 * 9/2003 Opfer ..... H01H 33/42 361/102
6,723,940 B1 4/2004 Book et al.
6,747,234 B2 6/2004 Traska et al.
6,794,596 B2 9/2004 Rhein et al.
6,867,385 B2 3/2005 Stoving et al.
6,930,271 B1 8/2005 Palmieri et al.
7,053,327 B2 5/2006 Benke et al.
7,158,369 B2 1/2007 Lammers
7,285,743 B2 10/2007 Martin
7,310,221 B2 12/2007 Lammers
8,008,594 B2 8/2011 Kurogi et al.
8,039,771 B2 10/2011 Trondsen
8,115,124 B2 2/2012 Maruyama et al.
8,178,812 B2 5/2012 Martin et al.
8,309,872 B2 11/2012 Peter et al.
8,445,804 B2 5/2013 Schellekens et al.
8,658,931 B2 2/2014 Heller et al.
8,723,069 B2 * 5/2014 Jecke ..... H01H 31/003 218/43
8,779,318 B2 7/2014 Espeseth et al.
8,854,795 B2 10/2014 Kim
8,946,581 B2 2/2015 Yabu et al.
9,048,367 B2 6/2015 Huang et al.
9,165,733 B2 10/2015 Reuber et al.
9,216,527 B2 * 12/2015 Martin ..... H01H 33/662
9,270,094 B2 2/2016 Yoshida et al.
9,425,006 B2 8/2016 Attar et al.
9,613,769 B2 4/2017 Gentsch et al.
10,276,318 B1 * 4/2019 Schafer ..... H01H 9/00
10,290,436 B1 * 5/2019 Schafer ..... H01H 9/02
10,290,437 B1 * 5/2019 Schafer ..... H01H 9/00
10,319,538 B1 * 6/2019 Schafer ..... H01H 9/02
2001/0025829 A1 10/2001 Marin-Pache et al.
2004/0227598 A1 11/2004 Ciarcia et al.
2005/0063107 A1 3/2005 Benke
2006/0124600 A1 6/2006 Harada et al.
2008/0067152 A1 3/2008 Kikukawa et al.
2008/0203063 A1 8/2008 Dullni et al.
2009/0015991 A1 * 1/2009 Hyrenbach ..... H02B 13/045 361/612
2009/0134125 A1 5/2009 Inoue et al.
2010/0032412 A1 2/2010 Trondsen
2010/0033295 A1 2/2010 Kent et al.
2010/0072045 A1 3/2010 Freundt et al.
2010/0078302 A1 4/2010 Erik et al.
2010/0243611 A1 9/2010 Takahashi et al.
2010/0326960 A1 12/2010 Heller et al.
2011/0000886 A1 1/2011 Isoya et al.
2011/0036812 A1 2/2011 Nagatake et al.
2011/0189887 A1 8/2011 Brostrom et al.
2011/0278262 A1 11/2011 Ryu
2012/0273464 A1 11/2012 Yeon
2013/0015161 A1 1/2013 Parashar
2013/0048611 A1 2/2013 Miki
2013/0062316 A1 3/2013 Renz et al.
2013/0092659 A1 4/2013 Baron et al.
2013/0213938 A1 8/2013 Bramhapurikar et al.
2014/0151339 A1 6/2014 Bottcher et al.
2016/0141122 A1 * 5/2016 Darko ..... H01H 9/24 200/50.01

FOREIGN PATENT DOCUMENTS

DE W02012042294 A1 4/2012
KR 100832326 B1 5/2008
WO 2011073452 A1 6/2011
WO 2011159248 A1 12/2011
WO 2012171570 A1 12/2012

* cited by examiner

ELECTRICAL SWITCHING DEVICE

CROSS-REFERENCE TO RELATED APPLICATIONS

The present application claims benefit of priority under 35 U.S.C. § 119 to U.S. Provisional Patent Application No. 61/793,880, entitled "Electrical Switching Device" and filed on Mar. 15, 2013, which is specifically incorporated by reference herein in its entirety for all that it discloses or teaches and for all purposes.

The present application is also related to U.S. Nonprovisional patent application Ser. No. 14/218,587 entitled "Insulated Switch"; U.S. Nonprovisional patent application Ser. No. 14/218,645 entitled "Insulated Interrupter"; U.S. Nonprovisional patent application Ser. No. 14/218,715 entitled "Interrupter Spring Guide Assembly"; and U.S. Nonprovisional patent application Ser. No. 14/218,756 entitled "Interrupter Having Integral External Contact", all of which are filed concurrently herewith, and all of which are specifically incorporated by reference herein in their entirety for all that they disclose or teach and for all purposes.

BACKGROUND

Electrical switching mechanisms for medium to high voltage applications are designed to be highly insulated. Insulation can be accomplished by creating large air gaps or by using insulating materials, such as oil or $SF_6$. As devices are made smaller or electrical surfaces are brought closer together, it can be extremely challenging to design and manufacture a safe and small electrical switching mechanism.

SUMMARY

In accordance with certain embodiments, an improved switching device and related components are provided.

In accordance with one embodiment an apparatus is provided that includes a switching mechanism rated to switch 27 kilovolts, a housing to house the switching mechanism, and an isolation point of the switching mechanism visible from outside the housing to visibly exhibit a physical open-circuit by the switching mechanism.

In accordance with another embodiment, a method is provided that includes installing a switching mechanism rated to switch 27 kilovolts, and observing through a housing for the switching mechanism an isolation point of the switching mechanism, the isolation point visible from outside the housing to visibly exhibit a physical open-circuit by the switching mechanism.

In accordance with yet another embodiment, an apparatus is provided that includes at least a first insulated compartment that has an insulated base and an insulated cover. A first electrical contact for a switching mechanism is disposed on a support within the insulated compartment; and a first shed insulator is disposed along the support and adjacent the electrical contact. A second shed insulator is also disposed along the support and adjacent the electrical contact and on an opposite side of the contact from the first shed insulator.

In accordance with another embodiment, a method is provided that includes disposing a first electrical contact for a switching mechanism between a first shed insulator and a second shed insulator along a support, and disposing the support in an insulated compartment formed by an insulated base and an insulated cover.

In accordance with yet another embodiment, an apparatus is provided that includes an upper insulating shield, a top portion of an interrupter seated in the upper insulating shield, a first lower insulating shield, and a lower portion of the interrupter seated in the first lower insulating shield.

In accordance with another embodiment, a method is provided that includes seating a top portion of an interrupter in an upper insulating shield; and seating a lower portion of the interrupter in a first lower insulating shield.

In accordance with still another embodiment, an apparatus is provided that includes an interrupter comprising an integrated external terminal configured for serving as a terminal in a switching mechanism.

And, in yet another embodiment, a method is provided that includes integrating an external terminal as part of an interrupter wherein the external terminal is configured to serve as a contact in a switching mechanism.

In accordance with still another embodiment, an apparatus is provided that includes a first support structure; an interrupter having an external terminal mechanically coupled with the first support structure; and an interrupter support mechanically coupled with a movable contact of the interrupter.

In accordance with another embodiment, a method is provided that includes mechanically coupling an external terminal of an interrupter with a first support structure, and mechanically coupling a movable contact of the interrupter with an interrupter support.

In accordance with one embodiment, an apparatus is provided that includes an insulator having a recess, and a spring for an interrupter disposed within the recess.

In accordance with still another embodiment, a method is provided that includes disposing a spring for an interrupter within a recess of an insulator.

Further embodiments will be apparent from this written description and the accompanying figures.

DETAILED DESCRIPTION

Figure 1:
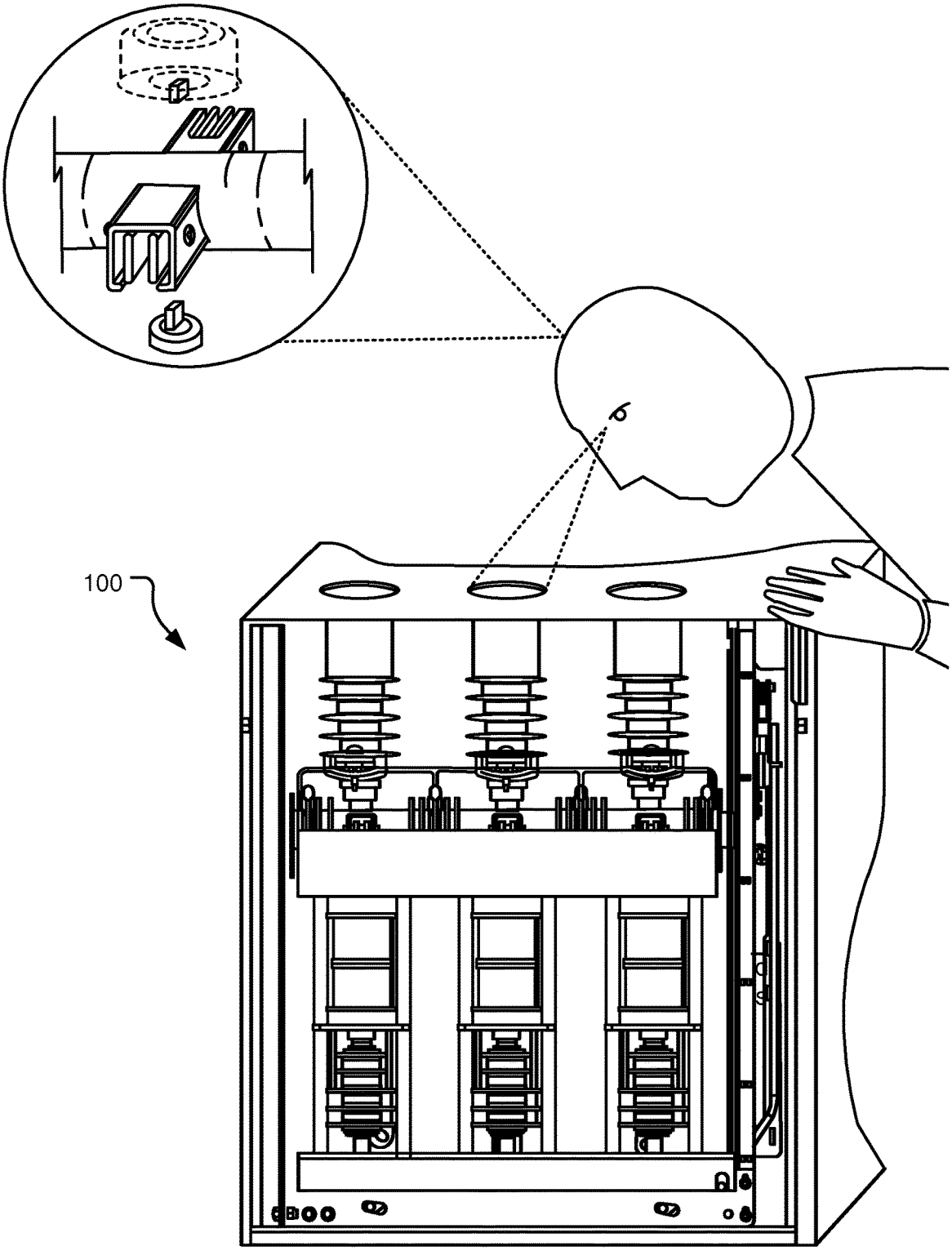
FIG. 1 illustrates an example of a switching mechanism that includes a visual open isolation point, in accordance with one embodiment.

Utilities are faced with the fact that much of their distribution switchgear equipment dates back well into the early 1900's and, in far too many cases, exceeds the intended lifespan of the equipment. Along with dated equipment and the significant dangers associated with it, various new regulatory requirements and utility safety policy changes have gone into effect, and utilities find themselves searching for replacement switchgear that must solve a myriad of problems.

Electric utilities want to replace their outdated equipment, especially outdated switches on underground networks, so as to avoid potential failures, explosions, and the financial liability associated with such events. However, the utilities face significant challenges in making such changes. For example, utilities would prefer not to use switches that contain harmful materials. To date, however, the utilities have not had the option of a switch that can fit into a confined underground vault and that does not use such harmful materials. One example of a harmful insulating material is insulating oil, which is highly flammable. Another example of a harmful insulating material is $SF_6$ gas, which is the number one greenhouse gas and is currently being regulated by the EPA. $SF_6$ gas also produces a dangerous $S_2F_{10}$ by-product during normal operation and that by-product can be released during a failure of a switch.

Another challenge that has faced utility companies is safely performing maintenance operations on equipment—especially equipment that operates at medium voltage or greater. Switchgear needs to be maintained or reconfigured periodically. Thus, utility operating crews need to be assured that the circuit components they want to work on are de-energized. For switchgear located in a housing, confirming de-energization can be difficult. Therefore, utility operating crews will often (1) operate an upstream switch to disengage electrical service to a piece of switchgear that they want to work on, and then (2) remove the electrical cables to that piece of switchgear. In this way, utility operating crews can visually ensure that a piece of equipment is safe to work on. Since the upstream switch generally controls other pieces of equipment, as well, a simple maintenance procedure can lead to a major disruption, power outage, and inconvenience. Also, it should be appreciated that the time it takes to disconnect a medium voltage cable from a piece of equipment, for example, is not a trivial task. Time and effort are expended to both disconnect and reconnect such cables.

In accordance with certain embodiments, certain ones of these issues are addressed by the present technology described herein. For example, one embodiment does not contain any oil or $SF_6$ gas as an interrupting or insulating medium. That embodiment is compact, small, modular in design, and is configurable into multiple switchgear designs thereby allowing the equipment to fit into existing manhole and vault locations. A visible open isolation point is visible through a clear cover and through tank-mounted viewing windows, providing the utility operating crews with a "visible" way to determine that a circuit is indeed "Open," isolated, and safe to perform their work without having to remove heavy electrical cables attached to the device.

In accordance with another embodiment, a multi-phase solid dielectric and air insulated interrupter with integral visible open isolation point assembly can be utilized. The interrupter and secondary isolation switch can be rated to withstand full system voltage. Moreover, the secondary isolation switch can allow an operator to visibly see three sets of "open" electrical contacts through clear window(s) of the switch tank and through a clear cover of the visible open isolation point assembly. In addition, multiple configurations and positions within a housing, such as a welded enclosure, may be utilized. It is believed that to date, no other solid dielectric switching mechanisms provide a visible isolation point that is rated to withstand full system voltage.

It should be appreciated that embodiments of the present technology are disclosed herein in the context of a switching mechanism. A "switching mechanism" is a device that can interrupt and/or energize an electrical circuit. For example, such a device can include a fault current interrupter, a load current interrupter, a switch, or a circuit breaker.

In accordance with another embodiment, a switching device is provided that has three operating positions (Open, Closed and Tripped Open). Due to the large voltages, ranging from, for example, 5,000 volts to 35,000 volts, and large currents, for example, up to 25,000 amps, that this device operates at under normal conditions, it is much more complex than a household circuit breaker operating at 120 volts. This embodiment can utilize an interrupter, such as a vacuum interrupter, as the primary interruption device to interrupt the flow of current in a circuit. Moreover, this device can utilize a combination of solid dielectric insulating materials, as well as air, to insulate the energized parts from one another within the switchgear, thus eliminating the need for oil or $SF_6$ gas as insulating mediums.

Unlike examples in your home, it is very difficult to separate high voltage cables from the switchgear. At home, one can simply unplug the vacuum cleaner, for example, from the electrical outlet before changing the dust bag or belt. Unplugging the vacuum cleaner from the wall outlet is creating a "visible, open circuit"—somebody can visually confirm that the circuit is open. With the cable removed from the electrical outlet, there is no way that the vacuum cleaner can become energized while you are working on it. Thus, when the cord is removed from the outlet, one has created a "safe to work" visible, isolation point from the electricity in the wall outlet.

A "visible and safe to work" system or process is utilized by utility operating crews working on medium voltage equipment. The utility operating crews determine by some means that a circuit is de-energized and "open." Historically, an operating crew would remove the cables from the oil-filled or $SF_6$ gas-filled switchgear to ensure that the switchgear was de-energized and thus safe to work on. In accordance with one embodiment, a "visible open circuit" can now be provided as part of a switching mechanism.

Certain embodiments described herein can be accomplished without the use of oil or $SF_6$ gas inside the switchgear, thus such embodiments are believed to be the safest switchgear for utility crews, the public, and the environment, on the market today.

Referring now to FIG. 1, an example of a visible and safe to work piece of switchgear can be seen. FIG. 1 shows a cutaway view of a switching mechanism 100 located in a housing—the cutaway view shows the side of the housing removed to illustrate the internal components of the switchgear. A utility crew member is shown looking through one or more windows at three visual open isolation points. The crew member is able to see visually that the electrical circuit is isolated from an energized circuit due to the visually separated contacts of all three phases of the disconnect switch at all three visual open isolation points. Thus, the utility member is able to confirm that it is safe to work on the equipment without having to disconnect any cables.

The embodiment of FIG. 1 utilizes air as an insulator. The design does not require that dangerous substances, such as flammable insulating oil or $SF_6$ gas, be used as an insulator. Instead, the design allows for the use of air. The air can be, for example, atmospheric air under ambient pressure and temperature conditions. Other non-toxic insulating gases could be used as well. For example, due to the dangerous by-products produced by sulfur based insulators, such as $SF_6$ gas, one might choose to use non-sulfur containing gases as the insulating gas. Other possible choices include inert gases having high dielectric breakdown qualities similar to air.

In one embodiment, a hermetically sealed container can be used as the housing. Use of an enclosed housing helps to reduce build up of dirt, debris, and/or water in the switching mechanism.

Figure 2:
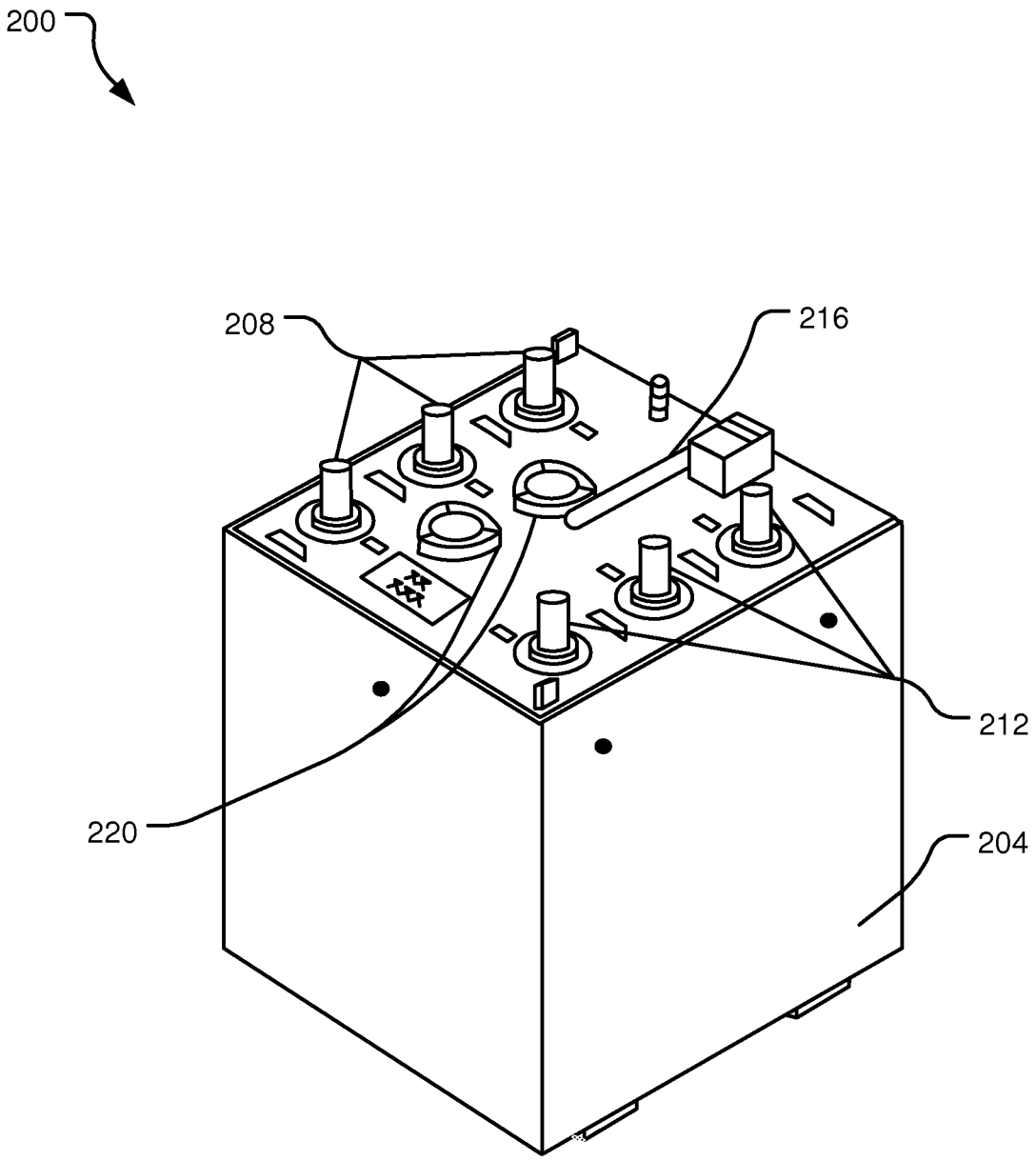
FIG. 2 illustrates an example of an air insulated piece of switchgear including windows for visually confirming that a circuit is in an open circuit condition, in accordance with one embodiment.

FIG. 2 illustrates an example of an enclosed piece of switchgear 200. The example in FIG. 2 shows a submersible, 600 amp, 2 way piece of switchgear. A non-encapsulated, three-phase, ganged interrupter assembly with integral visible open isolation point switch is disposed within the housing 204. There are six 600 amp electrical bushing connections 208 on the top of the housing. Three of the connections are for incoming three phase power. The remaining three connections 212 are for outgoing three phase power. An operating handle 216 is shown that performs open, close, and reset operations for the interrupter assembly. Windows 220 permit visualization of the visible isolation point for the switch.

In another embodiment, the external container can be shaped with a substantially circular circumference so as to fit through a standard manhole. Moreover, a multi-switch unit can be configured within the same tank. For example, three operating handles can be attached to three handle housings. One handle can be associated with each interrupter assembly mounted inside the switch tank. Nine bushings or external electrical connections could also be welded into the tank lid. The three interrupters with integral visible open isolation point devices could also be sealed into a welded stainless steel switch tank.

The combination of a handle with the "open" and "closed" positions as well as windows in a tank that allows the operator to visually confirm an open circuit provides a safety enhancement. For example, when a handle is down and parallel with the lid of the switch tank and the associated semaphore reads "Closed," the operator has the initial impression that the circuit is closed. However, the operator can look through viewing windows on the surface of the tank to confirm that the visible open isolation point is indeed "Closed." Similarly, when the handle is up and away from the tank surface, and the semaphore reads "Open," the operator has the initial impression that the circuit is open. However, the operator can look through the viewing windows on the surface of the tank to confirm that the visible open isolation point is open for each phase.

When an operating handle is down and parallel to the tank lid, but the associated semaphore reads "Open"—despite the fact that the handle is in the down position—the operator knows that the interrupter is in the "Tripped Open" position. To re-set the interrupter and to position the Visible Open Isolation Point device in the "Open" position, the operator can simply pull the operating handle up. The visible open isolation point device would then be seen in the "Open" position through the viewing windows.

Figure 3:
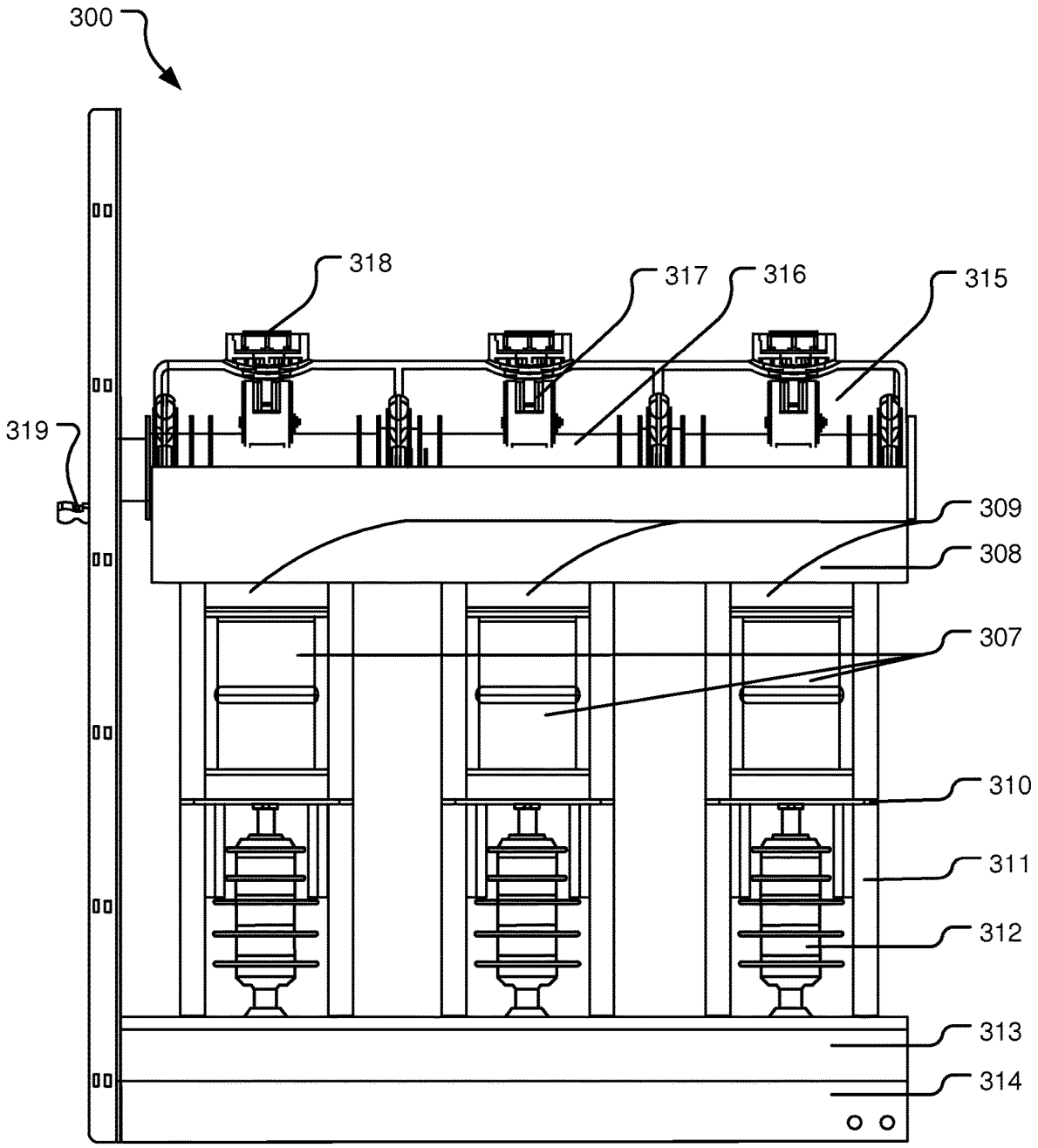
FIG. 3 illustrates an example of a switching mechanism with visible open isolation point phase switches disposed in a closed circuit position, in accordance with one embodiment.

Referring to FIG. 3, depicted is an example of an electrical switchgear assembly 300 including a stainless steel and solid dielectric frame structure. The image depicts a side-view of a non-encapsulated three-phase ganged embodiment, including three interrupters 307 for load and fault interruption of the three phases.

In the example of FIG. 3, the interrupters 307 are shown mounted between two solid dielectric molded epoxy resin structures. The upper structure 308 is the base for a visible open isolation point. Three mounting holes are molded into the bottom of the base and surrounded by raised molded shields 309. The holes are also guides for the interrupter's upper fixed external electrical terminal, such as a stab terminal, to be installed and sealed with a sealant, such as a room temperature vulcanizing (RTV) silicone sealant. The interrupter's upper fixed external electrical terminal is a solid copper contact that is silver plated. This external terminal is threaded at its base and is held in place from the inside of the base structure by a locking nut, for example, a one inch locking nut, that secures the interrupter to the bottom of the upper base structure. The interrupters 307 are mounted into three molded epoxy resin contact bottom guides 310. These molded epoxy resin dielectric structures have a hole and shield structure similar to the upper base. The interrupters 307 are installed and sealed into the contact bottom guide 310 with an RTV sealant. A contact bottom guide can also serve as a support structure for an interrupter.

Each interrupter's lower external movable contact includes a threaded bolt that is used to connect to the associated electrical bus work and lower drive mechanism, such as the associated push-pull rod assembly. Supporting the interrupters are twelve insulating rods 311, such as G-10 FR4 insulating rods. The G-10 FR4 material is a thermo-laminated glass polyester material. It exhibits superior dielectric strength, mechanical strength, stability in high temperature environments, and very high resistance to absorbing moisture. These twelve rods (six rods are shown and another six rods are positioned in symmetrical locations on the opposing side) insulate the upper and lower external interrupter contacts from a Basic Insulating Level (BIL) of 125,000 volts of electricity. The G-10 FR4 rods support the upper base structure as well as the contact bottom guides 310. Moreover, the G-10 FR4 rods couple together the upper base structure, the contact bottom guides, and the lower supporting structure 314.

In FIG. 3, beneath the interrupter contact bottom guides are the push/pull drive rod assemblies 312, each having an internal closing spring assembly. These push/pull assemblies within their silicone electrical sheds insulate and house the closing spring assemblies responsible for placing equal pressure on shafts of the movable contacts of the interrupters. The push/pull drive rod assemblies are connected to a lower drive assembly that is disposed underneath a fiberglass reinforced polymer laminate (GPO-3) insulating material 313 formed in a channel shape and covering the lower stainless steel structure 314.

In FIG. 3, a visible open isolation point assembly is shown that includes a visible open isolation point enclosure. The enclosure is shown fabricated from a clear cover 315, such as a molded polycarbonate cover, a rotatable drive shaft 316, parallel blade contacts 317, and upper electrical connection terminals 318. The upper electrical terminals can include stab contacts, for example, disposed beneath the cover which engage/disengage with multi-blade contacts (for example, parallel blade contacts) disposed on the rotatable shaft. A second set of parallel blade contacts is disposed on the opposing side of the rotatable shaft from the parallel blade contacts 317. For example, each pair of opposing parallel blade contacts can be formed by running two parallel bars directly through the rotatable drive shaft. Such parallel blade contacts can engage with the upper fixed external electrical contacts of the interrupters. Such upper fixed external electrical contacts of the interrupters can take the form of stab contacts.

The upper electrical terminals 318 allow one to connect the switch via insulated cables to electrical bushings mounted on the lid of a switch tank, for example. The rotatable drive shaft 319 is connected to an actuator, such as a pull handle and operating linkage 319. The operating linkage opens and closes the interrupters as well as the phase switches disposed on the rotatable drive shaft. Each phase-switch can serve as a visible open isolation point because it can be viewed from outside the switchgear. The term phase-switch is used to identify an individual switch that is in series with an interrupter. It can apply to a circuit having a single phase or to a circuit having multiple phases. In FIG. 3, three phase-switches are shown.

The linkage can be set so that when an operating handle—located, for example, on the outer surface of a switch tank—is pulled to the "open" position, the interrupter contacts for each phase of a circuit open completely before the linkage for the visible open isolation point is engaged to rotate the visible open isolation point shaft to the "Open" position. A position semaphore may also be used and located on the external handle housing to clearly identify the mechanism's position: Open (green indicator) and Closed (red indicator).

Figure 4:
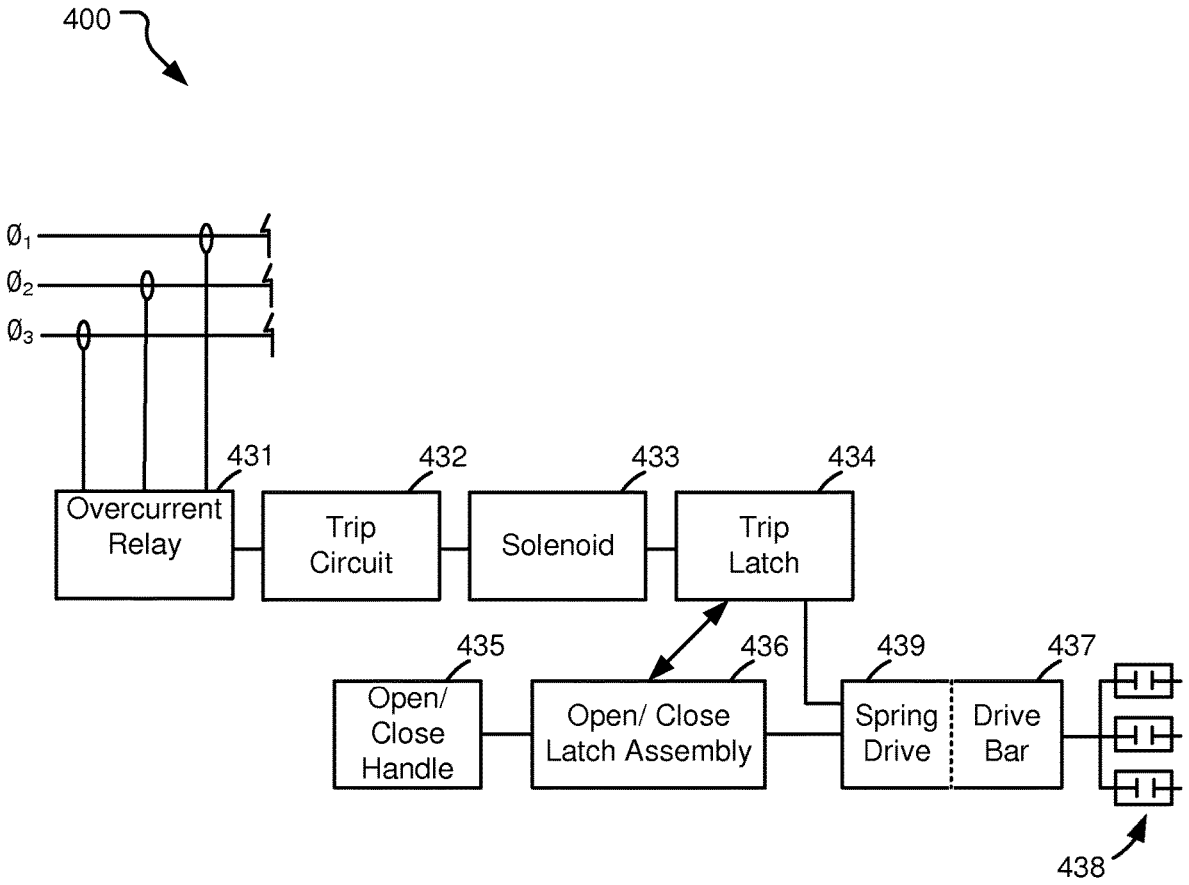
FIG. 4 illustrates a diagram for an interrupter actuation system, in accordance with one embodiment.

An example 400 of a lower drive assembly is depicted in FIG. 4. A solenoid 433 is installed and connected to a trip circuit 432 to receive a trip signal from an over-current relay device 431. A drive bar 437 is connected to a spring drive 439. A Trip Latch 434 causes the drive bar to open when the Trip Latch is operated. The Open/Close Latch Assembly 436 is actuated by the Open/Close Handle 433. The Open/Close Handle Latch Assembly causes the Drive Bar to open when the Open/Close Latch Assembly is actuated by an opening of the Open/Close handle. The Drive bar opens and closes interrupter contacts 438 and can be powered by Spring Drive 439.

Figure 5:
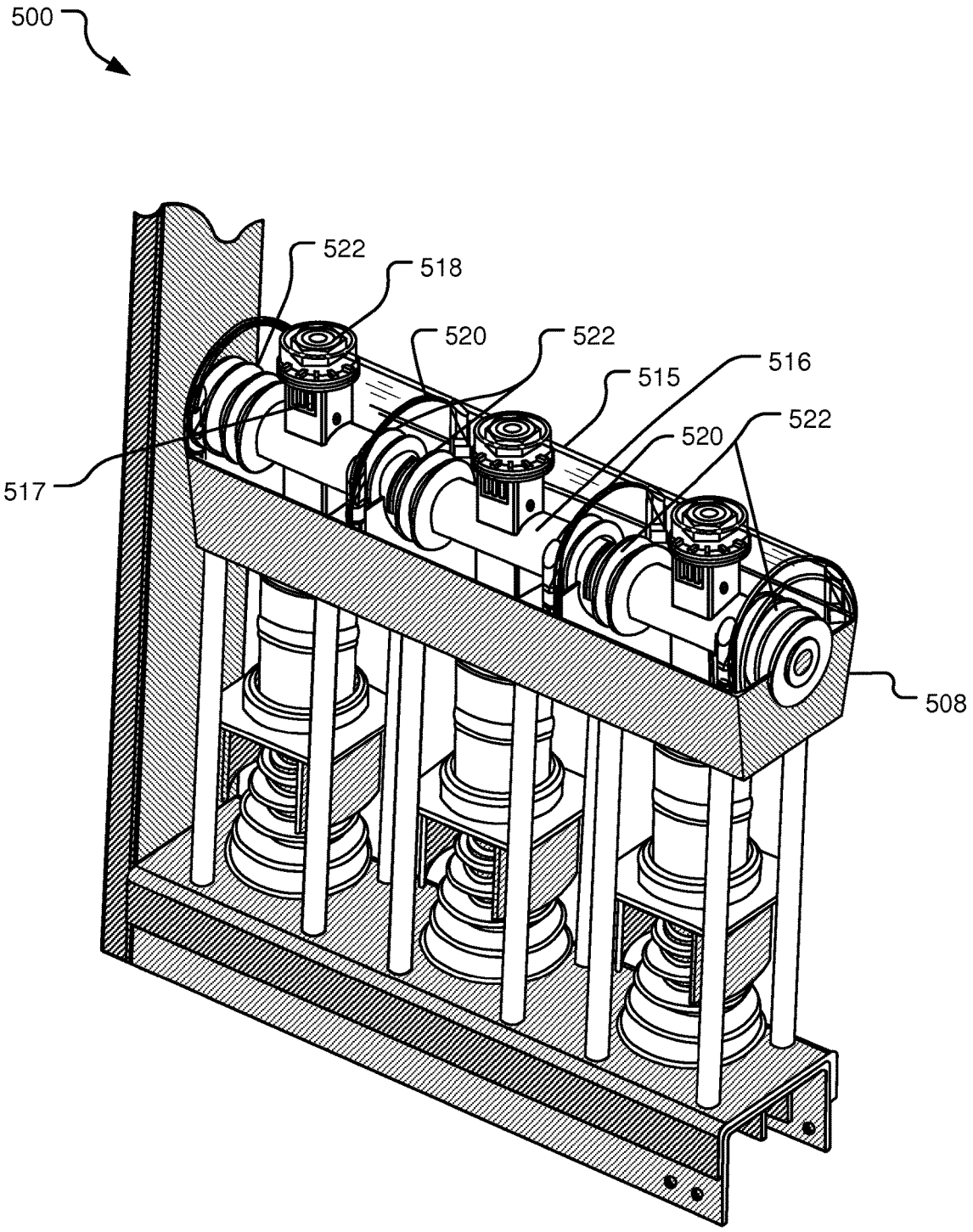
FIG. 5 illustrates another example of a switching mechanism with visible open isolation point phase switches disposed in a closed circuit position, in accordance with one embodiment.

FIG. 5 depicts an embodiment 500 of an upper assembly that includes a base 508, clear molded polycarbonate cover 515, visible open isolation point drive shaft 516, visible blade contacts 517, and upper electrical connection terminals 518. The upper electrical connection terminal can be connected by insulated cables to electrical bushings mounted on a lid of a switch tank. Similarly, the operating shaft is connected to the operating linkage that opens and closes not only the interrupters but also the visible open isolation points.

The design can include specific features to address the issues of voltage "creep" along the surface of the structure as well as "jump distances." Voltage "creep" refers to the fact that voltage and current travel along and on surfaces. For this reason, the drive shaft of the visible open isolation point device can utilize shed insulators 522. Sheds 522 are insulators affixed or molded to the drive shaft in such a way as to increase the surface distance between energized parts and thus to increase the distance that an arc must travel along the drive shaft, thereby increasing the distance between energized parts without increasing the length of the shaft. For example, such sheds can be made from epoxy resin.

Voltage "jump distances" refer to the ability of the voltage potential to build up on surfaces and create an arc jumping through air to another electrical contact associated with another phase or to ground. The design of the cover 515 and base 508 can include insulating barriers 520 formed into the molds of the cover 515 and base 508. These insulation barriers divide the cavity formed between the base and cover into three compartments. Moreover, these insulation barriers operate to block arcing from one phase to another because the phase-switches for each phase are located in separate compartments. Polycarbonate can be used for the barriers.

Figure 6:
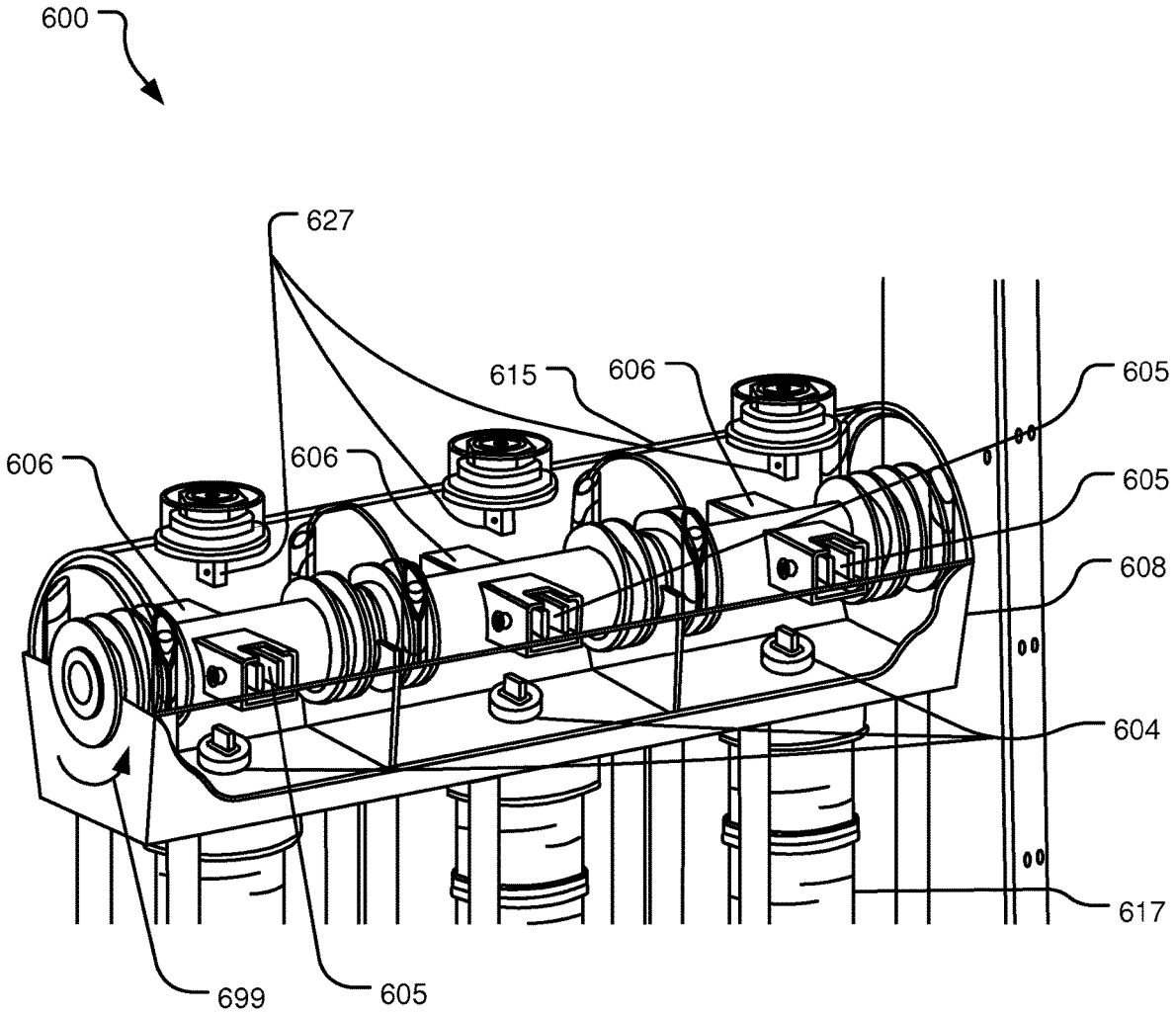
FIG. 6 illustrates an example of a switching mechanism with visible open isolation point phase switches disposed in an open circuit position, in accordance with one embodiment.

FIG. 6 illustrates an example 600 of an embodiment of a switch in the "Open" position. The shaft has been rotated and the contacts on the rotatable shaft are separated from three electrical contacts 627—one contact for each phase. The electrical contacts 627 are positioned in a clear polycarbonate cover 615. Contacts 604 disposed in the bottom of the base 608 protrude through the base. These contacts are part of the interrupter. Namely, they are external terminals of the interrupters.

Contacts 605 and 606 are located on rotatable shaft 616. As the shaft is rotated in the direction of arrow 699 parallel contacts 605 engage with stab contacts 627, while parallel contacts 606 (disposed under respective insulated covers) engage with stab contacts 604.

Figure 7:
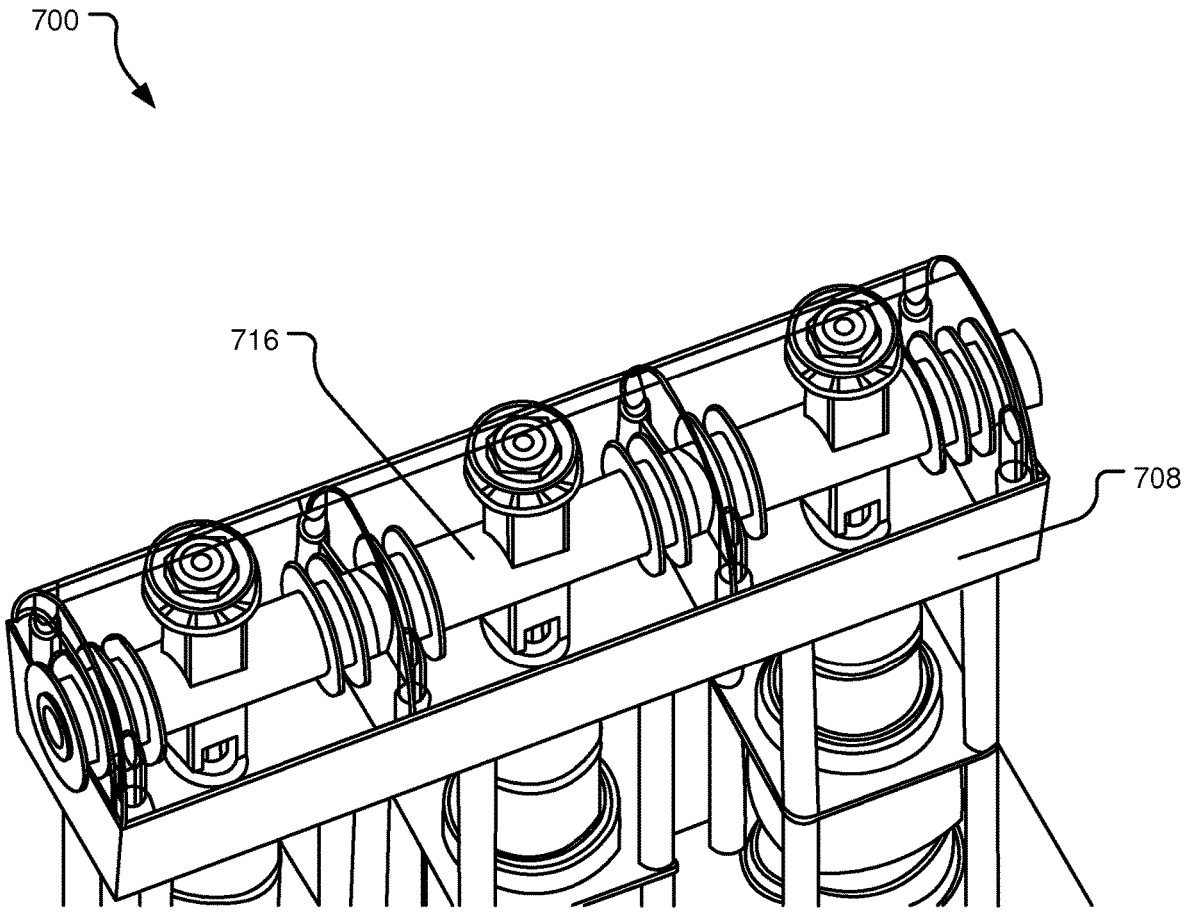
FIG. 7 illustrates another example of a switching mechanism with phase switches disposed in a closed circuit position, in accordance with one embodiment.

FIG. 7 shows an example 700 of the rotatable shaft rotated to a closed circuit position. In FIG. 7, the parallel contacts on the lower portion of shaft 716 are engaging the stab contacts on the base 708. In addition, the parallel contacts on the upper portion of shaft 716 are shown engaging the stab contacts disposed in the cover. The parallel contacts on the upper portion of the shaft and lower portion of the shaft are electrically connected for each phase. Thus, rotating the shaft into the closed position provides an electrical connection between the terminals on the top of the switching mechanism and the interrupters disposed below.

In accordance with one embodiment, a design can be implemented that is compact and small. Compact and small embodiments are useful in that they can be installed into pre-existing, relatively small manholes and vaults. One of the challenges to making electrical distribution equipment small is that medium and high voltage equipment require significant levels of electrical insulation. Some have relied upon insulating oil or $SF_6$ gas to provide insulation. However, such materials are dangerous, for a variety of reasons.

In accordance with one embodiment, unique insulating materials are utilized to provide sufficient electrical insulation without utilizing insulating oil or dangerous gases, such as $SF_6$. Materials that can be used to provide insulation include, for example, Bisphenol epoxy resins, NEMA G-10 FR4 epoxy-glass rods, room temperature vulcanizing (RTV) adhesive, Polyolefin heat shrink tubing, molded silicone sheds, non-conductive plastic bushings, fiberglass polyester NEMA GPO-3 sheet and channel insulating material, non-metallic fasteners, and a molded polycarbonate insulating cover. The result of combining these various materials in the design of a unit is that one can achieve the same electrical clearances of oil or $SF_6$-gas filled equipment without the need for oil or $SF_6$ gas for insulation. "Electrical clearances" are electrical measurements of pre-determined distances or levels of insulation capable of insulating or creating distance between energized components for the voltage the equipment will be subjected to.

In accordance with one embodiment, a switching mechanism is configured to be rated to be installed on electrical circuits energized up to 27,000 volts and with electrical clearances and Basic Insulation Levels (BIL) to meet or exceed 125,000 volts for 27,000 volt applications. This embodiment is also compact and easy to modify for a plug-and-play replacement design for older equipment dating back to the early 1900's.

Figure 8:
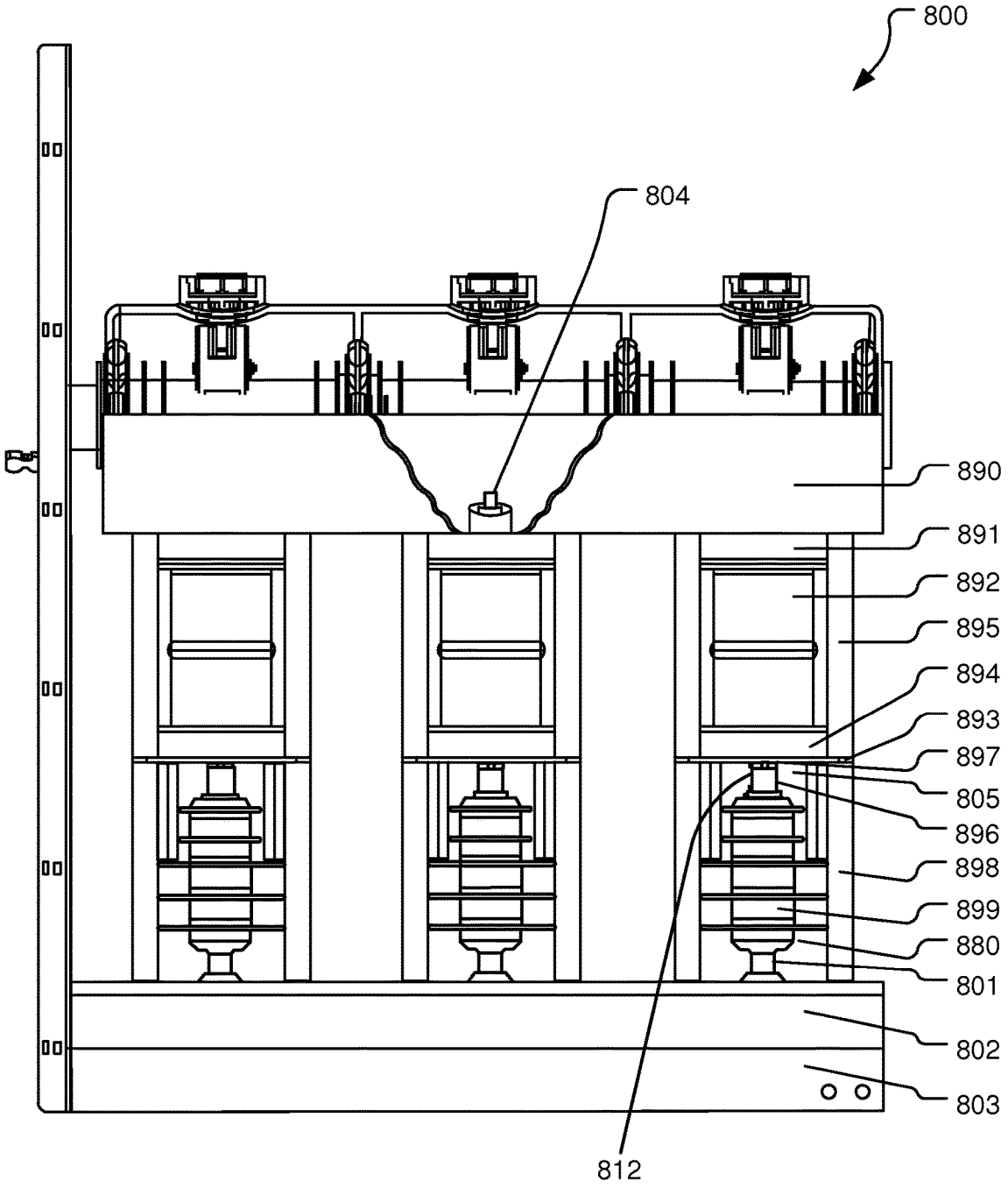
FIG. 8 illustrates an example of insulating components and support structures for a switching mechanism, in accordance with one embodiment.

FIG. 8 illustrates a side view of a switching mechanism 800 in accordance with one embodiment. FIG. 8 illustrates how some space saving features can be implemented. In FIG. 8, a base 890 forms part of the housing for a rotatable shaft. The base is shown coupled with a cover so as to provide a cavity for phase-switches disposed on a rotating shaft. The base can be made from Bisphenol epoxy resin, for example. Upper insulating shields 891 of the base 890 provide insulation around the top of interrupters 892. Each interrupter has a non-movable external upper contact that extends through an opening in the upper insulating shield 891 and through an opening in the base so as to extend into the cavity formed by the base and a cover. These external contacts can then be used to couple with corresponding contacts on the rotatable shaft. In one embodiment, the non-movable external upper contact has a stab shape. A stab shaped contact can interface with a parallel blade shaped contact mounted on the movable shaft.

The lower portion of the interrupter 892 is similarly mounted into a lower insulating shield, such as an interrupter contact bottom guide 893, to electrically insulate the interrupter. The interrupter contact bottom guide 893 can be a molded component that includes an additional insulating shield to insulate the interrupter contact. The insulating shield 894 can also be made of epoxy resin. A cowling 805 extends at least partially around the circumference of the insulator and serves as an electrical insulating shield for the lowest electrical connection point 896 between interrupter 892 and push/pull rod drive assembly 899. The push/pull rod drive assembly includes insulated sheds to provide further insulation for the connection point 896. Thus, in addition to the interrupter contact bottom guide 893 which serves as a first lower insulating shield for the interrupter, the insulating shield 894 and cowling 805 can serve as second and third lower insulating shields for an interrupter. RTV sealant adhesive is used to install, insulate, and seal the top and bottom edges of the interrupter 892 into upper insulating shield 891 of the upper base 890 and insulating shield 894.

To provide support for the structure, NEMA G-10 FR4 epoxy-glass insulating rods 895 can be used. For example, such rods can be used between the upper insulating shield and the lower insulating shield as insulating support members for the base/cover/rotatable switch structure. Such rods provide physical strength to support the base and hold the device together. Such rods also can maintain 27,000 volts of system voltage and Basic insulating level (BIL) rating of 125,000 volts for the entire device.

The lower portion of the mechanism is also supported by NEMA G-10 FR4 epoxy-glass insulating rods 898. Such rods provide support and maintain 27,000 volts of system voltage and Basic Insulating Level (BIL) rating of 125,000 volts from the lower interrupter contact 897 to the fiberglass polyester NEMA GPO-3 802 insulating barrier covering the steel frame 803. Machined in the insulating barrier are holes for push/pull rod drive assembly shafts 801 to connect to a lower drive mechanism. These holes can be insulated with non-conductive plastic guide bushings.

One embodiment can use and combine engineered components (including molded epoxy resin components, and custom electrical contacts), multiple insulating materials and air to provide a very compact and small assembly that can fit into (for example, as replacement switchgear) a pre-existing manhole or vault, all the while maintaining electrical clearances for successful operation and rating, without the need for oil or $SF_6$ gas as an electrical insulation. Oil has been used in switchgear since the early 1900's for both insulating and arc-quenching applications. In the 1960's, $SF_6$ gas was introduced into switchgear as a new form of dielectric insulation to potentially replace oil. The possibility of explosion and release of deadly by-products from normal operation make oil- and $SF_6$-filled switchgear extremely dangerous to operating crews and to the public.

Current non-oil and non-$SF_6$ switchgear use a process of encapsulating the interrupter in rubber or cycloaliphatic material, calling it a solid dielectric device. These designs do not include a visible open device or a safe to work isolation point that can withstand full system voltage and they rely on the rubber and cycloaliphatic materials to protect the device from the environment in the vault or manhole. At least one embodiment described herein provides a stainless steel switch tank housing to protect the interrupter with integral visible open isolation point from the underground vault environment. Placing such a device inside a sealed vessel permits the use of air as insulation for the integral visible open isolation point.

In FIG. 8, upper insulating shields 891 and lower insulating shields 894 are molded into the base 890 and into the interrupter contact bottom guide 893, respectively. These molded epoxy components and their built-in shields can provide a housing and barrier for the external contacts 804 and 897 of the interrupter. Room temperature vulcanizing (RTV) sealant may also be used to install and seal the interrupters into these molded components. Heat shrink insulation can be installed around the interrupter to complete the encapsulation. These multiple forms of insulations work together to encapsulate and insulate the interrupter from other energized components and stray voltages.

Notably, others have had to use an injection molding process to produce encapsulated components from expensive molds to reach an appropriate level of insulation. In accordance with at least one embodiment described herein, no such molding is necessary to achieve the appropriate level of insulation. Thus, no costly molds or capital equipment are required. The manufacturing process can be performed in-house where quality can be closely monitored. Expensive interrupters are not damaged or thrown away because of molding process errors that create voids in the solid dielectric material, thus making the encapsulated parts unusable. No voids are created during the insulation and assembly of interrupters. Moreover, the process and assembly is easily repeatable with little to no scrap created.

One design feature that allows a more compact design is the use of interrupters that remain along the same longitudinal axis during both an opening and closing of a switching mechanism. Such a design allows the workspace in front of the interrupters to remain constant regardless of whether the interrupters are in an "open" or "closed" position. Thus, the housing for the switching mechanism does not have to be sized for electrical clearance purposes to accommodate the worst case position for the interrupters. In this way, the volume of space needed by a housing to house a switching mechanism—or operational volume—can be substantially the same for a switching mechanism in both an open-circuit position and a closed-circuit position.

Similarly, the compact design techniques described herein allow the operational clearances for a switching mechanism to be substantially the same when the switching mechanism is in either an open-circuit position or a closed-circuit position.

By utilizing the volume saving techniques described herein, a compact switching mechanism can be implemented without the need for dangerous or harmful insulating materials. This allows switching mechanisms to be disposed, for example, in underground vaults, through manholes, and to retrofit 1900's era switches. Such retrofits can save time and expense for electrical service providers. Moreover, the design allows utility operating crews to safely determine that a switching mechanism has been deenergized before having to work on the equipment and without having to disconnect cables from the switchgear housing before performing a service operation.

Figure 9:
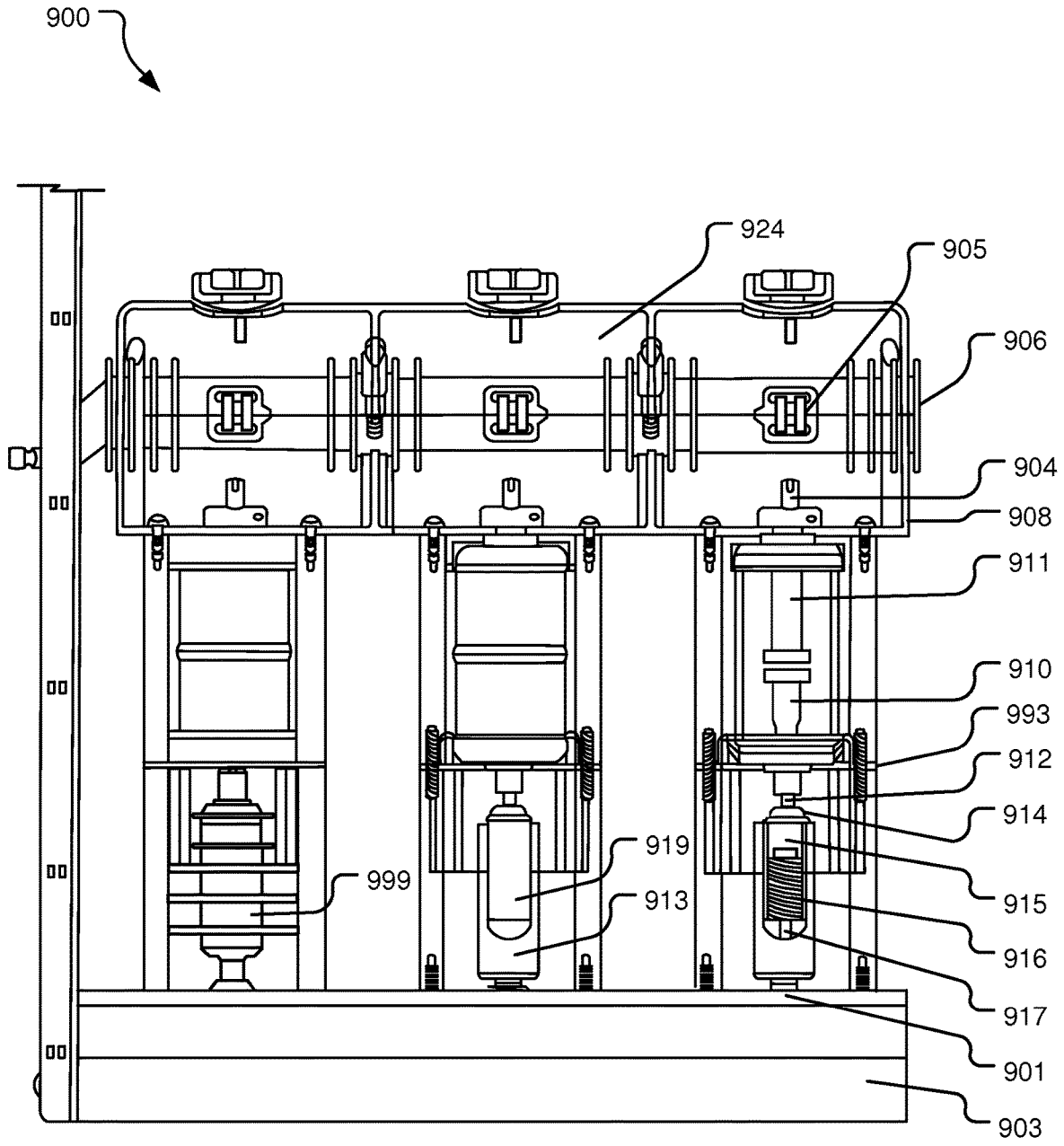
FIG. 9 illustrates an example of a push/pull rod assembly and interrupter contacts for a switching device, in accordance with one embodiment.

Depicted in FIG. 9 is an example of a switching mechanism 900. FIG. 9 shows three interrupters. On the left and center position the interrupters are shown substantially covered in a heat shrink insulation. For purposes of illustration, the far right interrupter has its heat shrink insulation and metalized ceramic outer shield removed to expose the inner fixed contact 911 and movable contact 910. A design of an interrupter contact drive spring and guide system is shown in FIG. 9. This design can self-calibrate and thus it is able to maintain the correct and constant amount of spring pressure throughout the lifetime of an interrupter. The design also can maintain the movable internal contact of the interrupter in an axial alignment. Thus, when mechanical or magnetic forces (for example, due to an electrical fault) occur, the movable contact still moves along the intended axis. Thus, the design is considered self-aligning.

Due to the nature of interrupter technology, interrupter contacts, when in the closed position, are held together under constant pressure to keep the contacts closed. Each of the two contacts 910 and 911 within the interrupter is under magnetic forces. The two forces are in opposition to one another and work to push the interrupter contacts apart. These forces increase under fault (or short circuit) conditions. Correct and constant pressure should be applied to the interrupter contacts over the lifetime of the switchgear, when in a closed position.

If the correct and constant pressure is not present, two issues can arise: (1) a highly resistive connection between the contact surfaces will cause a "heat rise," causing premature interrupter failure; (2) as interrupter contacts are operated, e.g., repeatedly opened and closed, the contact surfaces erode thereby reducing the amount of material at the contact surface. In accordance with at least one embodiment, a self-calibrating spring pressure device to hold the contacts together under both fault and normal conditions solves some or all of these problems.

FIG. 9 shows an example of a push/pull drive rod spring assembly. Internal to the push/pull drive rod spring assembly 913 and beneath the external insulating sheds 999, a machined cavity or recess holds a spring cup 919 specifically engineered with a solid spherical end in order to reduce voltage stress from any sharp metallic edges. This spring cup 919 is bonded inside the rod 913 to provide a solid base to thread and tap a hole 917 to provide a way to screw in a shoulder bolt to compress and captivate a compression spring 916. A calibrated compression spring 916 is installed into the spring cup to hold the interrupter's contacts closed.

Next, a shoulder bolt assembly is installed. The shoulder bolt assembly is made up of two machined components and a shoulder bolt 917. A first machined component 915 having a flat machined surface to press against the die spring and a partially threaded interior hole on the opposite end. A shoulder bolt 917 is installed through this machined part at the threaded end. Next, a second machined component 914 with both internal and external threads is installed in the first machine part to captivate the shoulder bolt. A gap is left inside of the first machined component to allow the shoulder bolt to move up and down inside the first machined component. The gap area is created to allow the compression spring to expand to keep the correct and constant pressure on the interrupter contacts as they erode with operation. The second machined component 914 includes a threaded center hole to which a threaded end 912 of the movable contact 910 is installed to connect the push/pull rod drive assembly to the interrupter.

Figure 10:
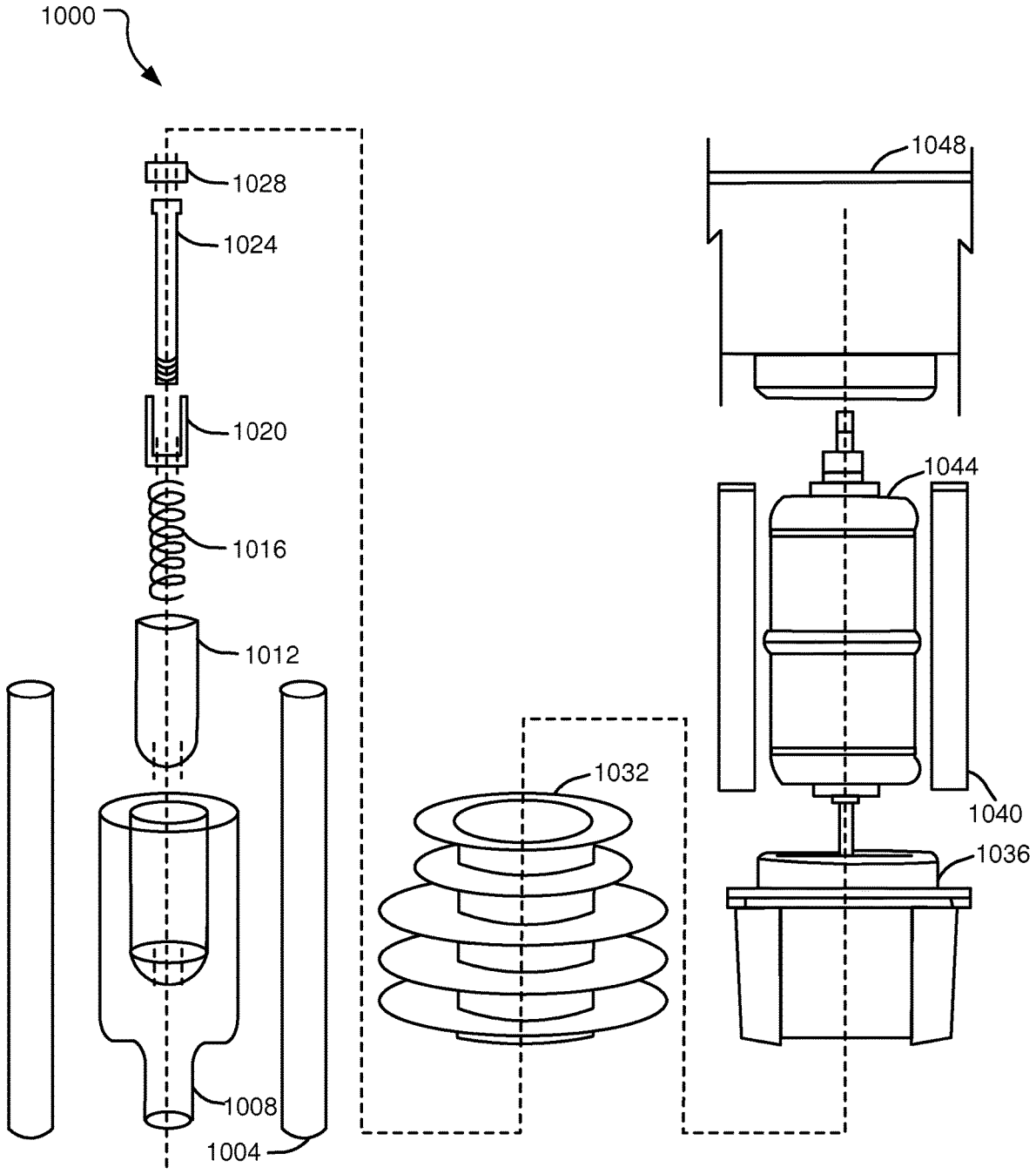
FIG. 10 illustrates another example of a push/pull rod assembly and interrupter for a switching device, in accordance with one embodiment.

An exploded view of an example 1000 of a self-calibrating assembly is shown in FIG. 10. FIG. 10 shows insulating rod(s) 1004. The insulator 1008 used as part of the push/pull rod drive assembly is shown having a cavity for receiving a spring cup 1012. The spring cup includes a hole in its bottom to allow a shoulder bolt to be secured to the insulator. Alternatively, the spring cup could be configured with a bore to anchor a bolt. Spring 1016 is shown for placement within the spring cup. Shoulder bolt 1024 is disposed through the bottom of bushing 1020 through spring 1016 and through the bottom of spring cup 1012. Bushing cap 1028 is secured to the top of bushing 1020. Insulated cover 1032 may be disposed on top of insulator 1008 and its assembly components.

The upper portion of interrupter 1044 is seated in the base 1048 and protected by the upper contact guide molded into the base. The lower portion of interrupter 1044 is seated into lower contact guide 1036. The base 1048 and lower contact guide 1036 are also insulated by support rod(s) 1040. The lower contact of the interrupter extends through the opening in lower contact guide and screws into a hole in the top of bushing cap 1028.

Referring again to FIG. 9, the movable contact 910 internal to an interrupter can be subjected to magnetic forces occurring between other energized components inside the switchgear. To eliminate a potential problem of the movable shaft 910 of the interrupter being pulled or pushed from its axial path, a shaft guiding system is designed into the push/pull rod drive assembly and the contact bottom guide 993. In the spring guide assembly, the first machined component 915 is designed to center itself inside the spring cup 919 and drive the threaded shaft 912 up and through the contact bottom guide. The push/pull drive rod assembly shaft 913 is also guided through to the lower drive assembly by a non-conductive guide bushing 901. The entire assembly is supported by G-10 FR4 insulating rods to provide structure and meet the required Basic Insulation Level (BIL) or exceed 125,000 volts for 27,000 volt applications. This guide system reliably drives the interrupter closed and open in a direct and consistent axial path over the life of the switchgear without the need for re-calibration.

FIG. 9 illustrates that the interrupter can be maintained in alignment and proper position by certain support components. The base structure 908 serves as a first support structure for the interrupters. This first support structure can be coupled with the external terminal of an interrupter. For example, a "D" cut shape can be used for the interrupter's external terminal. A corresponding hole can be cut in the base structure to receive the "D" cut terminal. By sizing the hole to merely permit insertion of the "D" cut terminal but not allow rotation of the interrupter, once the interrupter is inserted the interrupter can be positioned in a predetermined orientation by virtue of the sizing and positioning of the hole in the base structure. This external terminal is threaded at the base and is held in place from the inside of the base structure by a locking nut, for example a one inch locking nut, that secures the interrupter to the bottom of the upper base structure. This terminal can serve as the non-movable contact for the interrupter.

A contact bottom guide can also serve as an interrupter support structure. Each interrupter's lower external movable contact includes a threaded bolt that is used to connect to the associated electrical bus work and a drive mechanism, such as the associated push-pull rod drive assembly.

Still further, the frame 903, such as a stainless steel frame, can provide another point of support. The push/pull rod can be coupled at one end to the frame 903 and coupled at its other end to the interrupter support structure. Since the push/pull rod is coupled to the movable contact, these points of support help maintain the axial alignment of both the push/pull rod and the movable contact.

Figure 11:
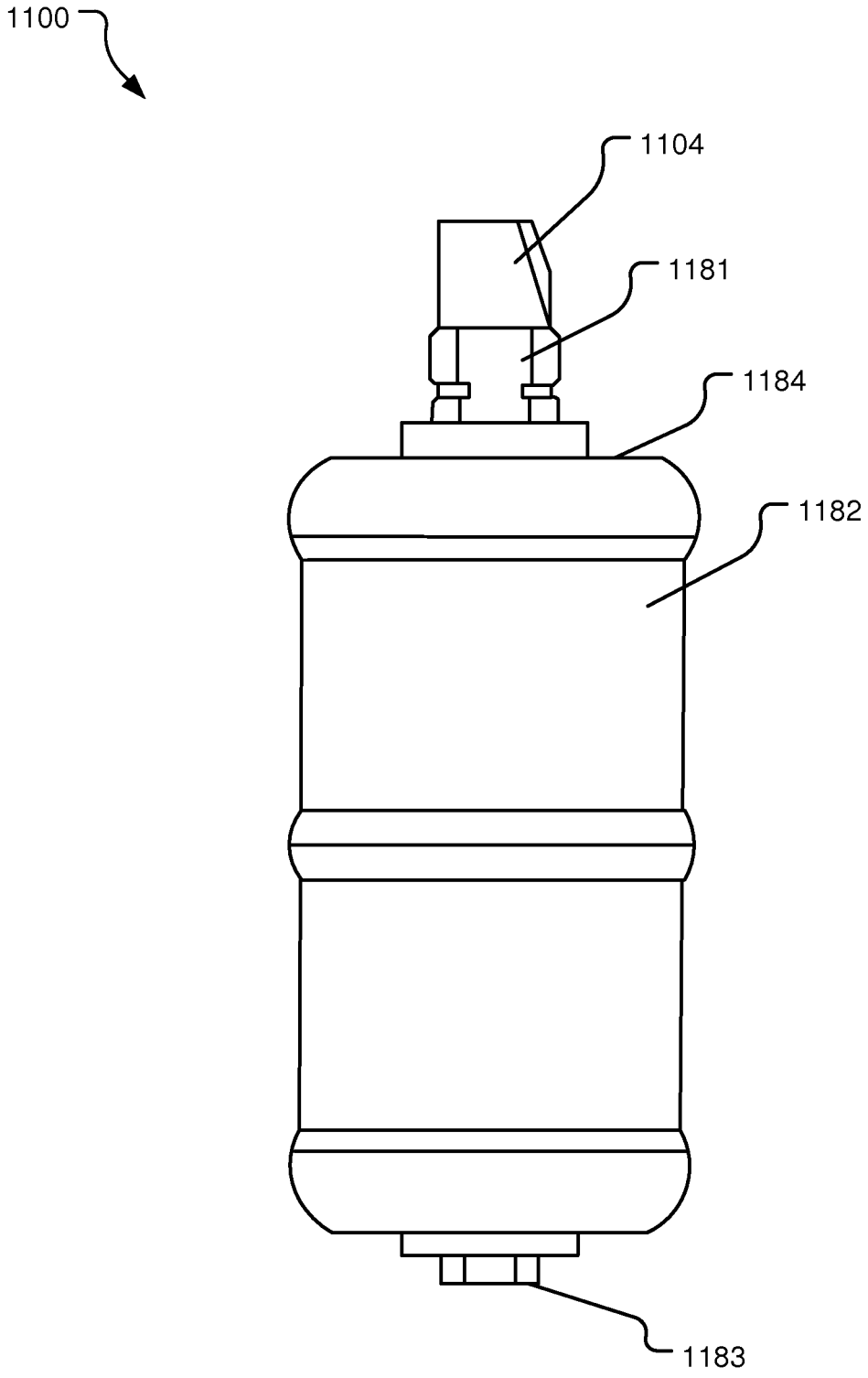
FIG. 11 illustrates an example of an insulated interrupter having an external terminal suitable for serving as part of a switching mechanism, in accordance with one embodiment.

FIG. 11 illustrates the external features of an interrupter 1100 in accordance with one embodiment. The external contact 1104 can be a solid copper, silver plated electric "stab" connection. This contact 1104 and the threaded position guide 1181 can be inserted into and through the bottom of the base of a visible open isolation point device. The contact 1104 can serve as the lower electrical contact (sometimes referred to herein as a terminal) for a phase switch of the visible open isolation point device. In accordance with another embodiment, the external contact of the interrupter can be formed in the shape of a multi-blade contact, such as a parallel blade contact that mates with a stab contact during operation.

FIG. 11 also shows a second contact 1183 of the interrupter. Both the first and second contacts can be disposed in a container 1184. Contact 1104 can be fixed in the container so as to be non-movable. Contact 1183 can be movable. For example, it can be coupled with a push/pull rod drive assembly to allow it to be opened and closed.

In one embodiment the container can be evacuated so that the interrupter serves as a vacuum interrupter. In FIG. 11, the container houses a substantial portion of both the first and second contacts. Only contact portions 1104 and 1183 are exposed. This provides additional insulation for the interrupter contacts so as to reduce arcing. Moreover, FIG. 11 shows that the container 1184 is covered by an insulating layer of material. Such an insulating material can be utilized to cover a substantial portion of the container, e.g., at least a majority of the surface area of the container. One example of insulating material that can be used is heat-shrink tubing. In another embodiment, the heat shrink tubing is used to cover all but the exposed portions of the contacts 1104 and 1183. In accordance with one embodiment, for example, the interrupter can be rated to interrupt 27,000 volts.

Referring again to FIG. 9, the internal operation of an interrupter can be illustrated. Depicted in the right hand side interrupter of FIG. 9, are two internal electrical contacts. Contact 911 is fixed and contact 910 is movable. These electrical contacts are inside the interrupter and cannot be seen through the solid metalized ceramic insulating walls of the interrupter. By integrating an external contact (or terminal) into the design of the interrupter, one is able to reduce the overall height of the entire interrupter with integral visible open isolation point assembly. Such a design lowers the overall height of the switching device by approximately two inches, in accordance with one embodiment. Two inches is significant when the depth of the vault might only be 36 inches.

The interrupter contacts, located inside the interrupter, cannot be seen—they are merely being illustrated by the transparent depiction in FIG. 9. These contacts perform the electrical load and fault interruption. The parallel electrical contacts 905 which can be seen extending through the visible open isolation point shaft 906 provide the "visible" open sets of contacts required for a "safe to work" visible isolation point. The lower electrical stab contacts 904 can also be seen when viewing at an angle through the viewing window and clear cover 924 of the visible open isolation point device.

Figure 12:
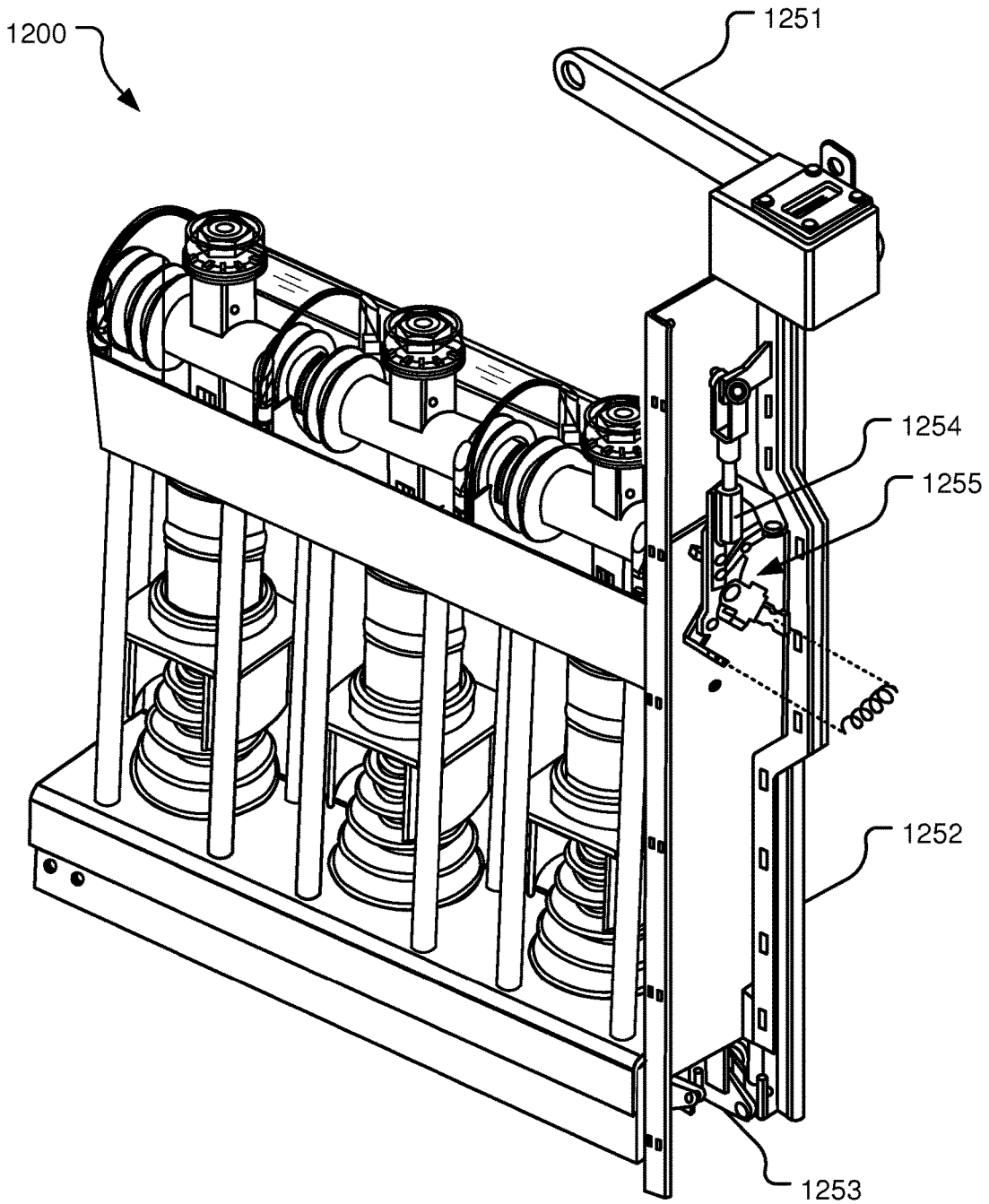
FIG. 12 illustrates a switching mechanism with an actuator disposed in a closed circuit position, in accordance with one embodiment.

In accordance with one embodiment, an actuator can be utilized that allows operation of a switching mechanism. Such an actuator can include a single handle coupled with a linkage that activates two separate drive mechanisms. For example, FIG. 12 shows a one handle, 2 stage switching mechanism 1200. In FIG. 12, an interrupter and visible open isolation point have two separate drive mechanisms that are attached on one linkage assembly 1252. The interrupter is designed to perform the entire load and fault interruption operations while the visible open isolation point device is designed to be a "dead break" switch that only opens after the electrical current is interrupted by the interrupter. This is accomplished by making an adjustable linkage system 1253 and 1254 so that when the operator pulls the handle 1251 to an "Open" (e.g., de-energized) position, a bell crank coupled to the handle rotates and pulls the operating linkage 1252 up and engages the pivot for the lower drive bar assembly. The lower drive bar then pulls the drive latch to top dead center. Once reaching top dead center, the latch mechanism's spring assembly pulls the interrupters to "Open," e.g., in 2.5 cycles, thereby de-energizing the circuit. The interrupter contacts open first and interrupt the circuit, then the visible open isolation point drive linkage 1254 is engaged and rotates the visible open isolation point drive assembly 1255 and thus rotates the drive shaft to the "Open" position. The three phase-switches disposed on the rotatable drive shaft are thus rotated to open positions. When the operator sees that the visible open isolation point drive shaft is rotated to the "Open" position, they know that the circuit is "Open" and "Isolated" and thus safe to work. Conversely, when closing the operating handle 1251, the visible open isolation point device linkage 1254 engages first to rotate and close the phase switches first before engaging the interrupter lower drive assembly 1253 to close the interrupter's contacts for the three phases.

In FIG. 12, the actuator allows a single movement of a single handle to open and close the interrupters and the phase-switches of the visible isolation point. During an open operation, the operator can simply move the handle through its designed range of motion and cause the linkage to first open the interrupters for the three phases before opening the phase-switches for the three phases. Similarly, during a close operation, an operator can simply move the handle through its designed range of motion to cause the phase-switches to first close and then to cause the interrupter contacts to be closed. This provides an ease of operation and removal of chance for damage to the switching mechanism. For example, the actuator prevents an operator from inadvertently using the phase-switches to open a circuit when the circuit is under load. Similarly, the actuator prevents an operator from inadvertently using the phase-switches to energize a load. Instead, the interrupters which are designed and rated for more extreme conditions can be utilized as the first device to open a circuit and the last device to close a circuit. This also allows the phase-switches to be rated for load current and for fault current, but not for interrupting current.

Figure 13:
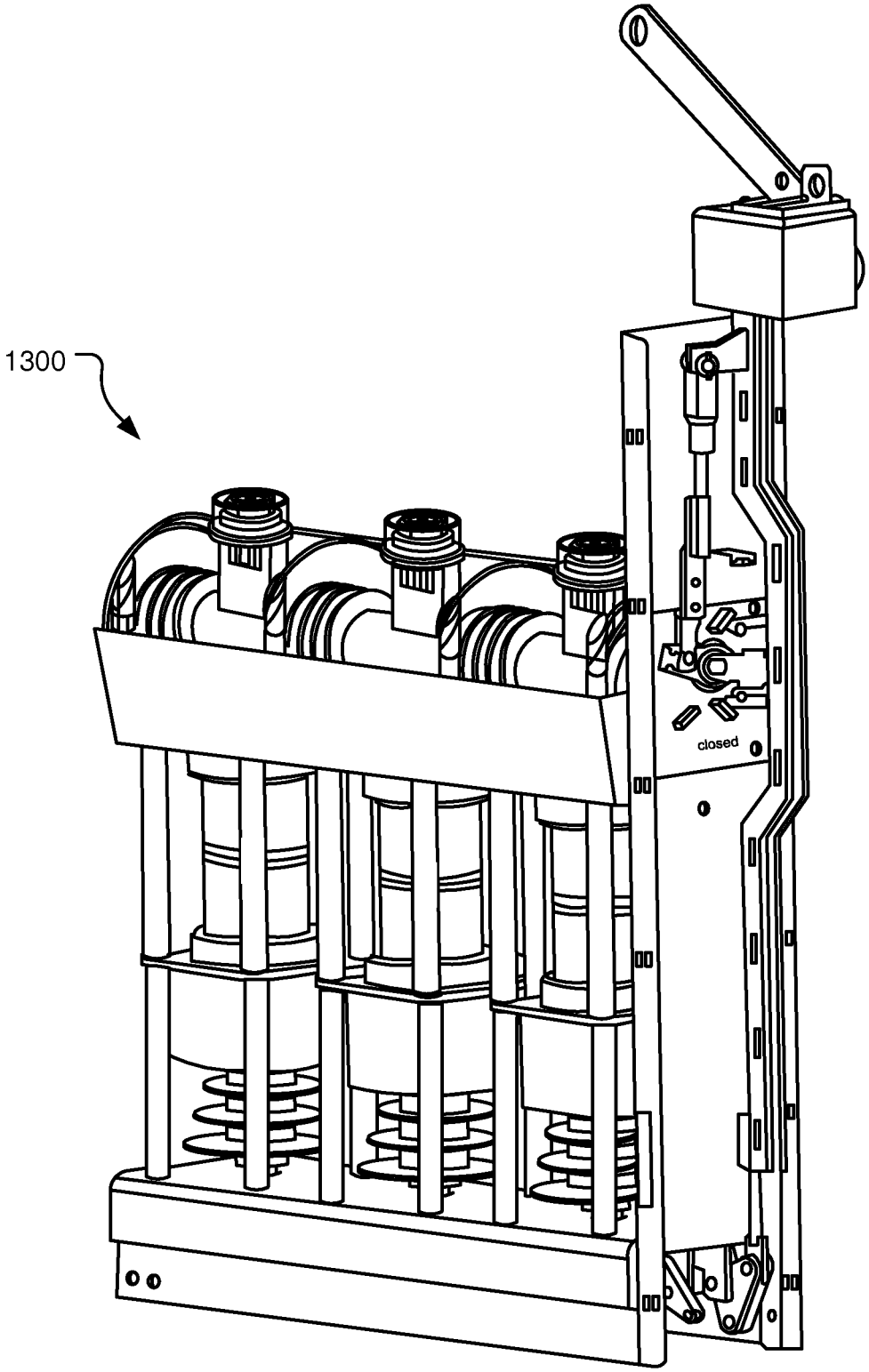
FIG. 13 illustrates a switching mechanism with an actuator disposed in a position where a set of interrupters are opened but a set of phase switches of a visual open isolation point are still closed, in accordance with one embodiment.
Figure 14:
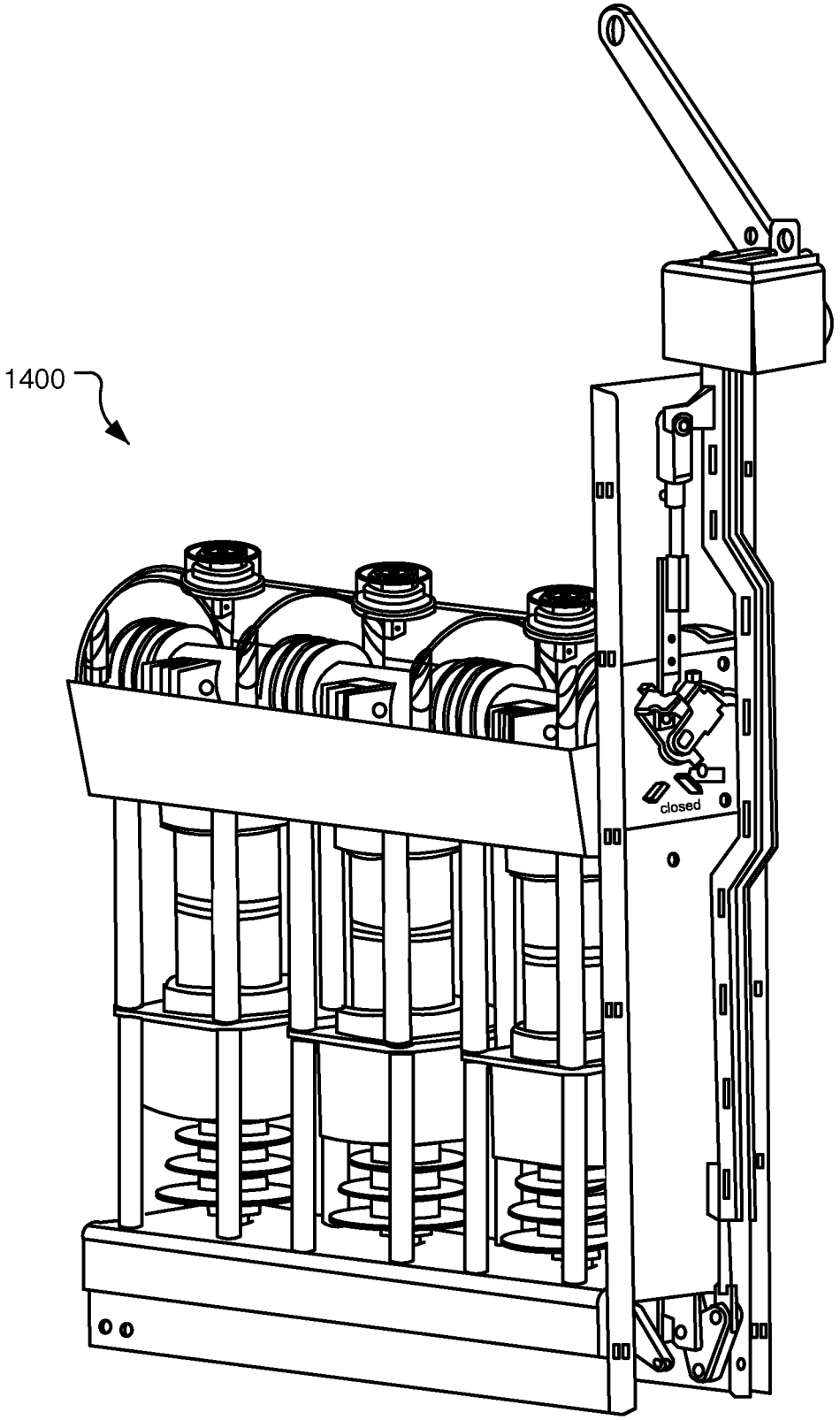
FIG. 14 illustrates a switching mechanism with an actuator disposed in a position where a set of interrupters are opened and a set of phase switches of a visual open isolation point are also opened, in accordance with one embodiment.

FIG. 13 illustrates an example 1300 that shows the actuator handle partially moved through an opening sequence. The linkage has actuated the lower drive mechanism in order to cause the lower drive mechanism to open the interrupters. The phase switches of the visible isolation point are still shown in the closed position along the rotatable shaft, however. In FIG. 14 illustrates an example 1400 with the actuator handle in a completely open position. The lower drive assembly is shown as actuated. Similarly, the upper drive assembly has rotated the rotatable shaft to dispose the phase-switches of the visible open isolation point in an open position. Thus, the open position causes the interrupters and the visible open isolation switches to both be in open circuit positions. Reversing the sequence of FIGS. 12, 13, and 14 will cause the switching mechanism to close, in accordance with these examples. A spring is shown in FIG. 12 coupled to the outward extending arms of the visible open isolation point drive linkage. The spring is shown under tension. The spring is also disposed over the outward extending arms in FIGS. 13 and 14. When the handle activates the latch to open the visible open isolate point phase-switches, the spring rotates the arms and causes the drive shaft for the visible isolation point phase-switches to rotate. One example of a handle, linkage, and drive system, such as that shown in FIGS. 12, 13, and 14, is available from Innovative Switchgear Solutions, Inc. of Dacono, Colo.

Figure 15:
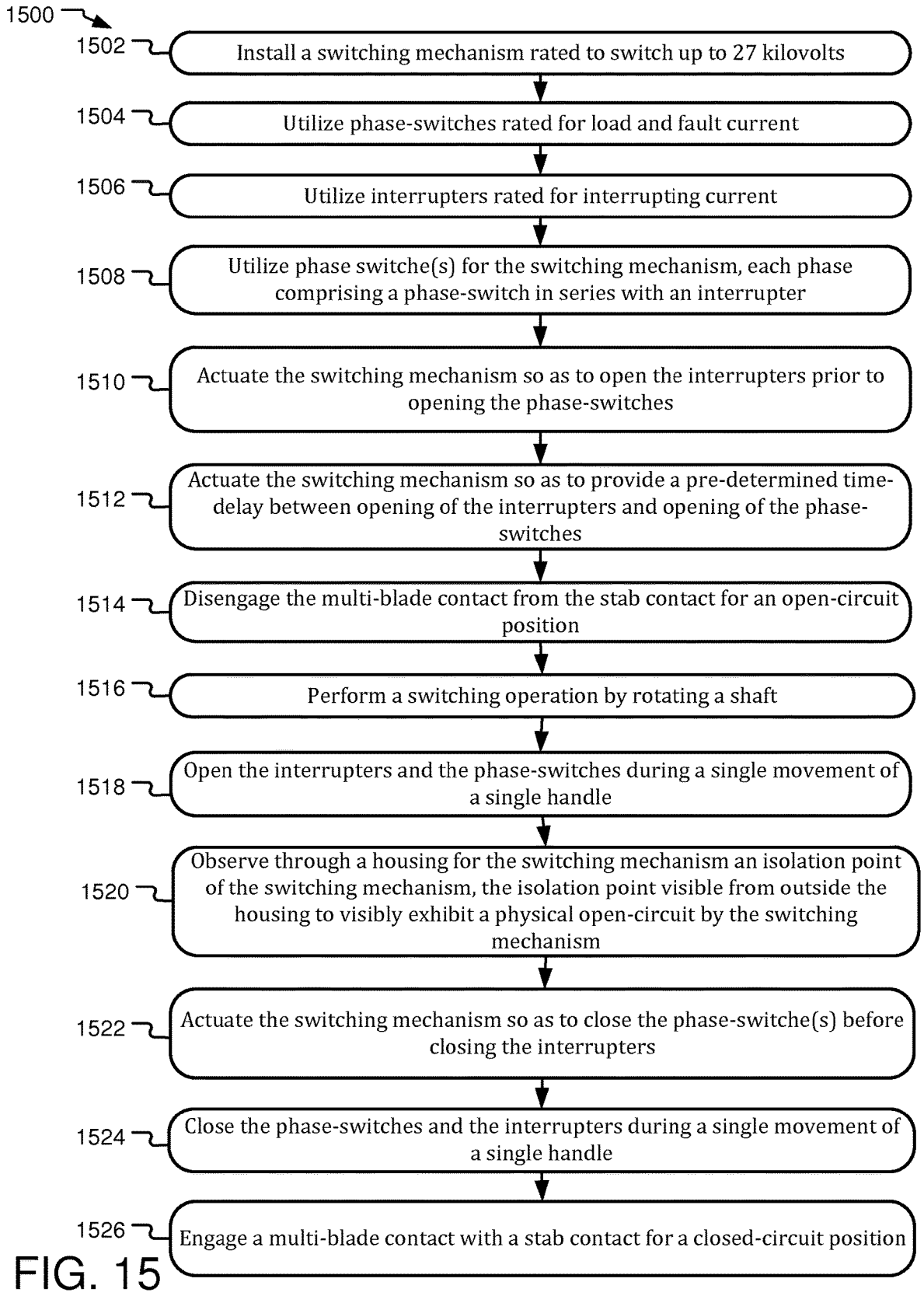
FIG. 15 illustrates a flow chart demonstrating a method of operating a piece of switchgear, in accordance with one embodiment.

Embodiments can also be described as methods. For example, FIG. 15 is a flow chart 1500 illustrating a method of operating a piece of switchgear, in accordance with one embodiment. In operation 1502, a switching mechanism is installed and is rated to switch up to 27,000 volts. As part of the switching mechanism, phase-switches are utilized that are rated for load and fault current, in accordance with operation 1504. Similarly, in accordance with operation 1506, interrupters are used in the switching mechanism that are rated for interrupting current. Operation 1508 shows that three phases can be used for the switching mechanism in the embodiment of FIG. 15. It should be appreciated that single phase or multi-phase switching mechanisms could be utilized in other embodiments.

Once a piece of switchgear is installed, it can be operated and serviced from time to time. For example, it can be disconnected from service and worked on. To work on the switchgear, an operator, such as utility personnel, confirms the switchgear is de-energized before approaching or contacting components. The embodiment in FIG. 15 allows a user to visually confirm whether a switching mechanism is in an open-circuit or closed-circuit configuration by actually allowing the user to see a break in the circuit. Phase-switches are utilized to show visible open isolation points for each phase of a circuit.

In operation 1510, an operator uses an actuator to actuate the switching mechanism. The switching mechanism is actuated so as to open the interrupters prior to opening the phase-switches. The linkage of the actuator can be adjusted to provide a pre-determined time delay between actuating the opening of the interrupters and the phase-switches. Such a time delay allows the interrupters to break the electrical circuit. This is shown in operation 1512.

Various contact arrangements can be utilized for the phase-switches. In the embodiment of FIG. 15, multi-blade contacts and stab contacts can be utilized to engage and disengage with one another. Thus, operation 1514 shows that a multi-blade contact is disengaged from a stab contact to create an open circuit position for a phase-switch. Operation 1516 further explains that the phase-switches can be opened and closed via a rotating shaft. Thus, in accordance with operation 1516, rotating such a shaft performs a switching operation. Moreover, operation 1518 highlights that the opening of the interrupters and phase-switches can be accomplished via a single movement of a single handle. Such actuation allows the operator to easily perform the opening and closing of a switching mechanism without having to operate more than one handle.

Once the handle has been moved to an "OPEN" position, the operator can observe through a housing for the switching mechanism an isolation point of the switching mechanism. The isolation point is visible from outside the housing and visibly exhibits a physical open-circuit via the switching mechanism. This is illustrated by operation 1520.

When an operator is ready to close a switching mechanism, the operator can actuate the switching mechanism so as to close the phase-switches before closing the interrupters, as shown in operation 1522. Closing the phase-switches before closing the interrupters avoids the phase switches from experiencing any arcing at phase-switch contacts during energization. As shown by operation 1524, a single movement of a handle can be used to close the phase-switches and the interrupters. Also, multi-blade contacts of the phase-switches can be engaged with stab contacts of the phase-switches to close the phase-switch circuits in this embodiment.

It should be appreciated that in accordance with this embodiment the interrupters can be operated along a fixed longitudinal axis. Thus, the interrupter body does not move in order to open or close contacts. Rather, the interrupter body is positioned along the fixed longitudinal axis when the interrupter is in an open-circuit position and a closed-circuit position.

Figure 16:
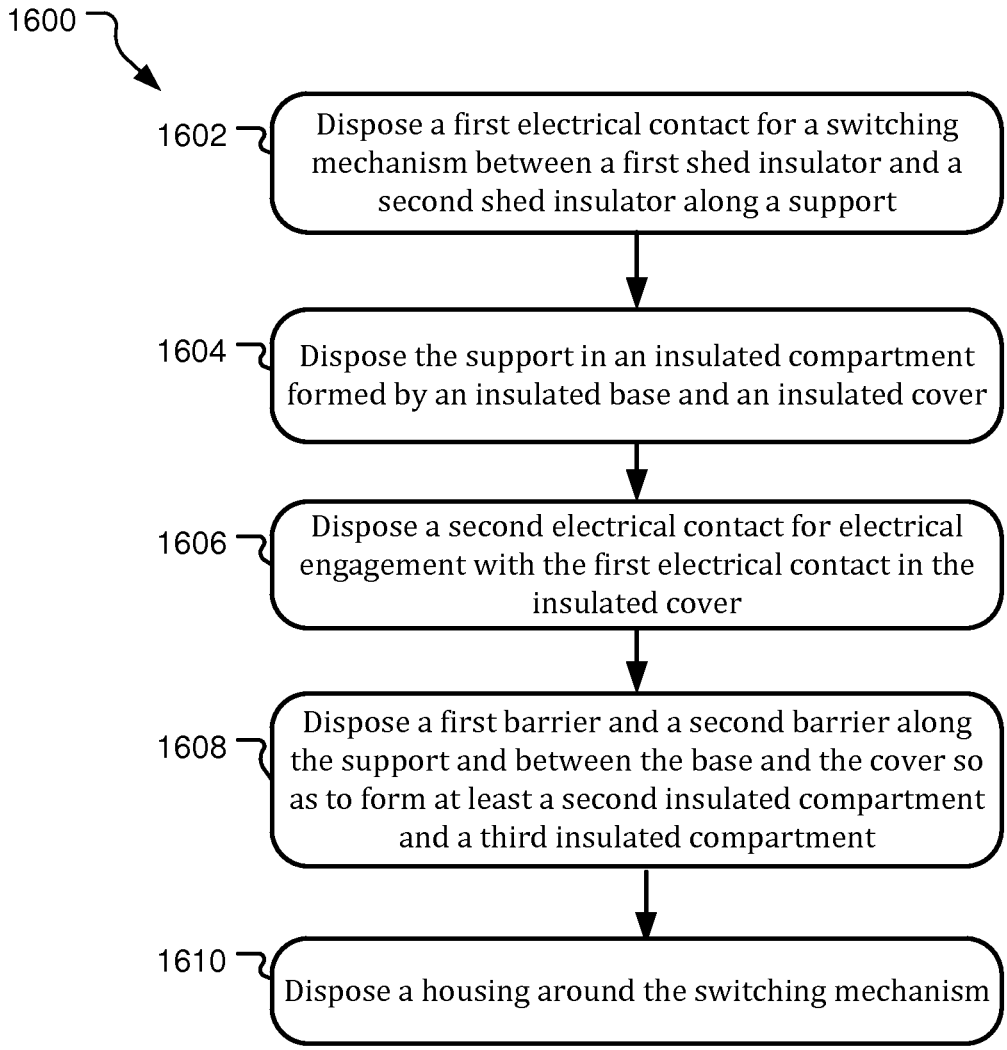
FIG. 16 illustrates a flow chart demonstrating a method of insulating a piece of switchgear, in accordance with one embodiment.

Referring now to FIG. 16, a method of insulating a piece of switchgear can be illustrated by flow chart 1600. In operation 1602, a first electrical contact is disposed between a first shed insulator and a second shed insulator. For example, the support can be a rotatable shaft that is used for a phase-switch at a visible open isolation point. In operation 1604, the support is disposed in an insulated compartment formed from an insulated base and an insulated cover. A second contact can be disposed in the compartment for engagement with the first electrical contact, as shown by operation 1606. In operation 1608, a first barrier and a second barrier are disposed along the support and between the base and the cover so as to form at least a second insulated compartment and a third insulated compartment. This allows three phase-switches to be disposed in the separate compartments, for example.

Figure 17:
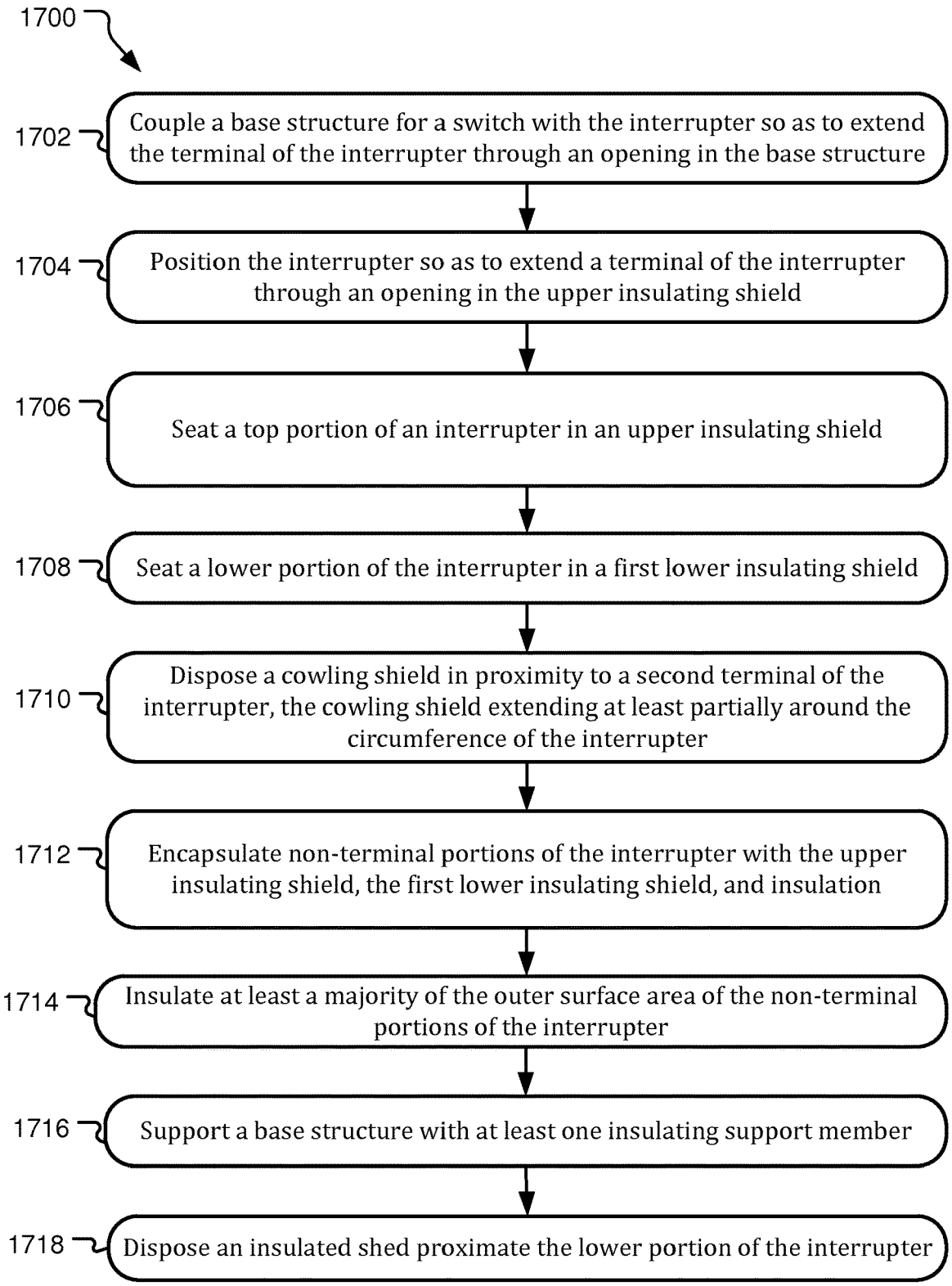
FIG. 17 illustrates a flow chart demonstrating a method of insulating an interrupter, in accordance with one embodiment.

In FIG. 17, a method of insulating an interrupter is illustrated in flow chart 1700 in accordance with one embodiment. In operation 1702, a base structure for a switch is coupled with an interrupter so as to extend a first terminal of the interrupter through an opening in the base structure. In operation 1704, the interrupter is positioned so as to extend a second terminal of the interrupter through an opening in an insulating shield. In operation 1706, a top portion of the interrupter is seated in an upper insulating shield. The upper insulating shield can be part of the base structure that extends partially down the side of the interrupter, when seated, and substantially or completely around the interrupter so as to cup the upper portion of the interrupter. Such insulation helps to shield the first terminal of the interrupter from electrical faults. The interrupter can be sealed to the upper insulating shield with a sealant.

In operation 1708, a lower portion of the interrupter is seated in a first lower insulating shield. Again, the lower insulating shield can include one or more sidewalls that extend partially down the side of the interrupter, when seated, and substantially or completely around the interrupter so as to cup the lower portion of the interrupter. Such insulation helps to shield the second terminal of the interrupter from electrical faults. The interrupter can also be sealed to the lower insulating shield with a sealant.

A cowling shield can be disposed in proximity to the second terminal of the interrupter in operation 1710. The cowling shield can extend partially or completely around the circumference of an electrical connection between the lower (or second) terminal of the interrupter and the push/pull rod assembly for the interrupter. The push/pull rod assembly can be used to close/open the contacts of an interrupter.

The surface of an interrupter can also be covered with insulation. For example, a substantial portion of the interrupter can be covered with insulation. Through the use of different insulating techniques, the non-terminal portions of an interrupter can essentially be encapsulated. For example, an interrupter can essentially be encapsulated by the upper insulating shield, the lower insulating shield, and a layer of insulation disposed on the container for the interrupter, as illustrated by operation 1712. Operation 1714 illustrates that one might alternatively insulate a majority of the outer surface area of the non-terminal portions of an interrupter.

Additional insulating materials can be utilized with the structural support components. For example, operation 1716 illustrates that the base structure can be supported with at least one insulating support member.

It should also be appreciated that the push/pull rod assembly can be insulated by an insulated shed that is placed proximate the lower portion of the interrupter, as shown by operation 1718.

Figure 18:
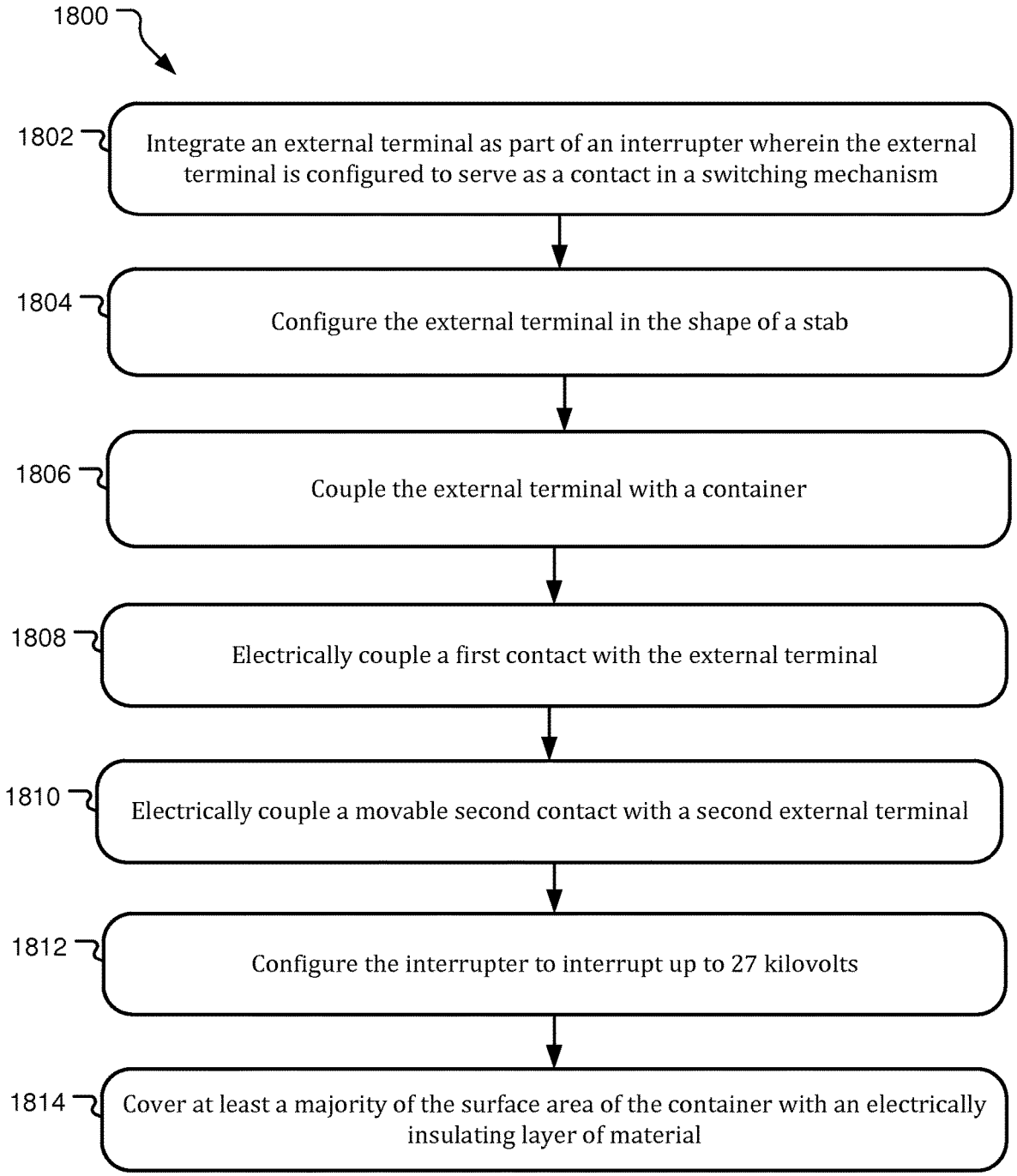
FIG. 18 illustrates a flow chart demonstrating a method of configuring an interrupter to have an external terminal, in accordance with one embodiment.

Referring now to FIG. 18, a flow chart 1800 illustrates an example of a method for configuring an interrupter to have an external terminal. An interrupter can utilize two contacts, for example, that interface with one another to complete an electrical circuit. In the case of a vacuum interrupter, for example, the two contacts interface with one another with the vacuum. The contacts are electrically coupled to external terminals of the interrupter. By configuring one of the electrical terminals to be an integral part of the interrupter—for example an extension of a non-movable contact of the interrupter—one can save space in the configuration of a piece of switchgear. Thus, in operation 1802 an external terminal is integrated as part of an interrupter. The external terminal is configured to serve as part of a contact for a switching mechanism. In operation 1804, the external terminal can be configured in the shape of a stab connector. In operation 1806, the external terminal is coupled with the container of the interrupter. And, operation 1808 shows that the external terminal can be electrically coupled with a first contact of the interrupter, such as a non-movable contact of the interrupter. Similarly, operation 1810 shows that a second contact, such as a movable contact, can be electrically coupled with a second external terminal. The interrupter can be configured to withstand voltages, such up to 27,000 volts, as shown by operation 1812. Moreover, at least a majority of the surface area of the container can be covered with an electrically insulating layer of material, as indicated by operation 1814.

Figure 19:
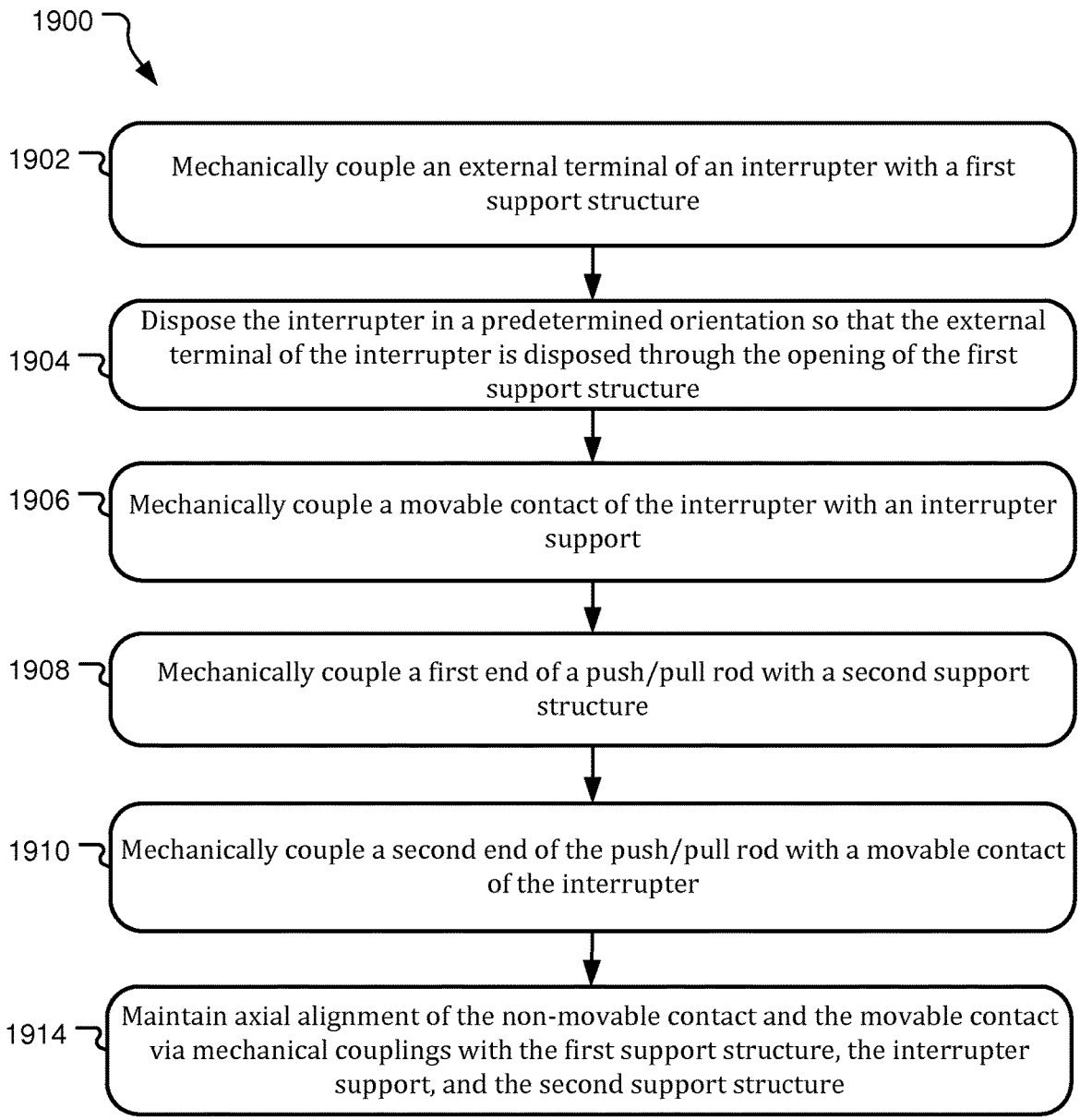
FIG. 19 illustrates a flow chart demonstrating a method of mounting an interrupter so as to maintain alignment of the interrupter's contacts during use, in accordance with one embodiment.

In FIG. 19, a flow chart 1900 illustrates a method of mounting an interrupter so as to maintain the alignment of the contacts of the interrupter during use. In operation 1902, an external terminal of an interrupter is mechanically coupled with a first support structure, such as a base for a switch. Operation 1904 shows that this can be accomplished by disposing the interrupter in a predetermined orientation so that the external terminal of the interrupter is disposed through an opening in the first support structure. Similarly, a lower portion of the interrupter can be mechanically coupled with a lower support structure. For example, the portion of a movable contact that extends outside of the interrupter can be mechanically coupled with an interrupter support, as shown by operation 1906.

In operation 1908, a first end of a push/pull rod can be mechanically coupled with a second support structure, such as the stainless steel base for a piece of switchgear. Operation 1910 shows that a second end of the push/pull rod can be mechanically coupled with the movable contact of the interrupter. Finally, operation 1914 shows that axial alignment of the non-movable contact and the movable contact can be maintained via such mechanical couplings, e.g., the mechanical coupling with the first support structure, the mechanical coupling with the interrupter support, and the mechanical coupling with the second support structure.

Figure 20:
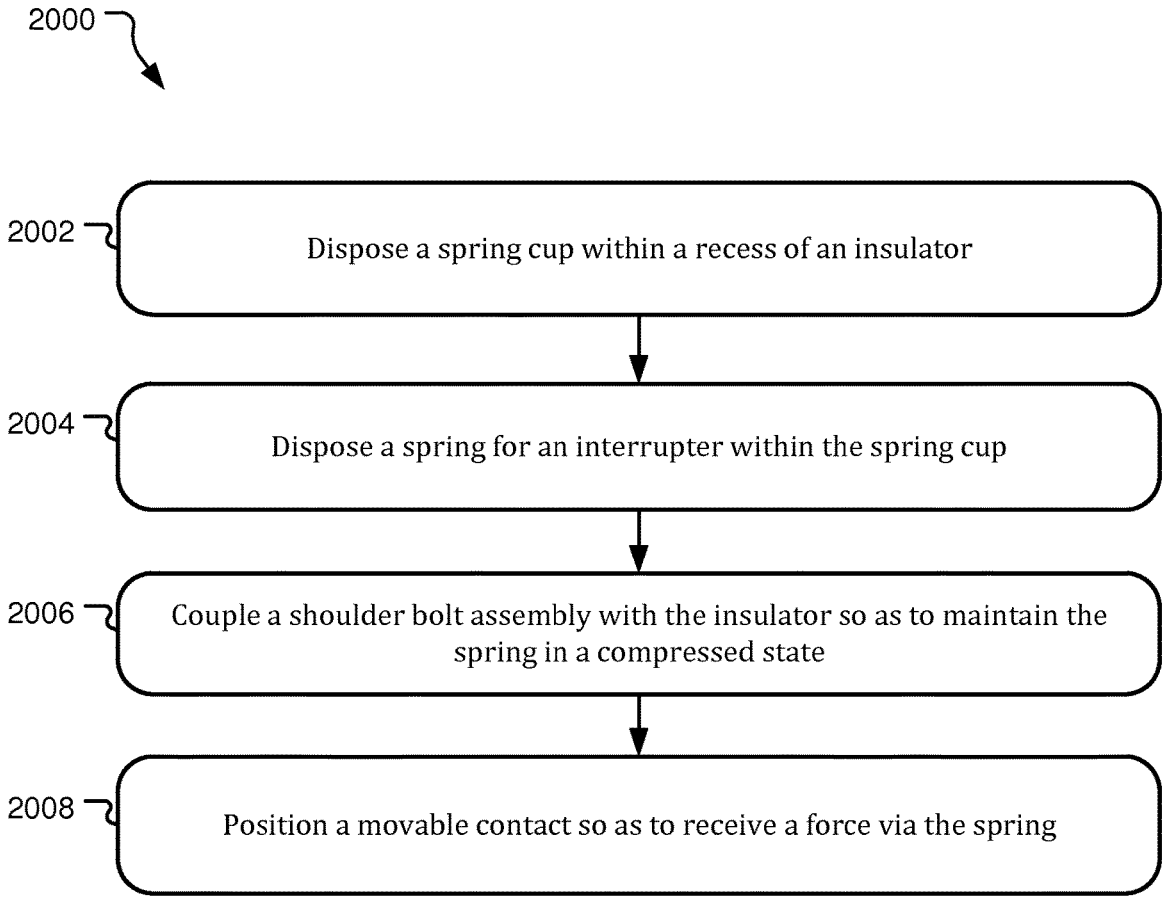
FIG. 20 illustrates a flow chart demonstrating a method of reducing the height of an insulating assembly, in accordance with one embodiment.

FIG. 20 illustrates a flow chart 2000 demonstrating a method of reducing the height (or length) of an insulating assembly. For example, the height of an insulated push/pull rod assembly can be reduced in accordance with one embodiment. In operation 2002, a spring cup is disposed within a recess of an insulator. In operation 2004, a spring for an interrupter is disposed in the spring cup. In operation 2006, a shoulder bolt assembly is coupled with the insulator so as to maintain the spring in a compressed state. And, in operation 2008, a movable contact is positioned so as to receive a force from the spring.

Figure 21:
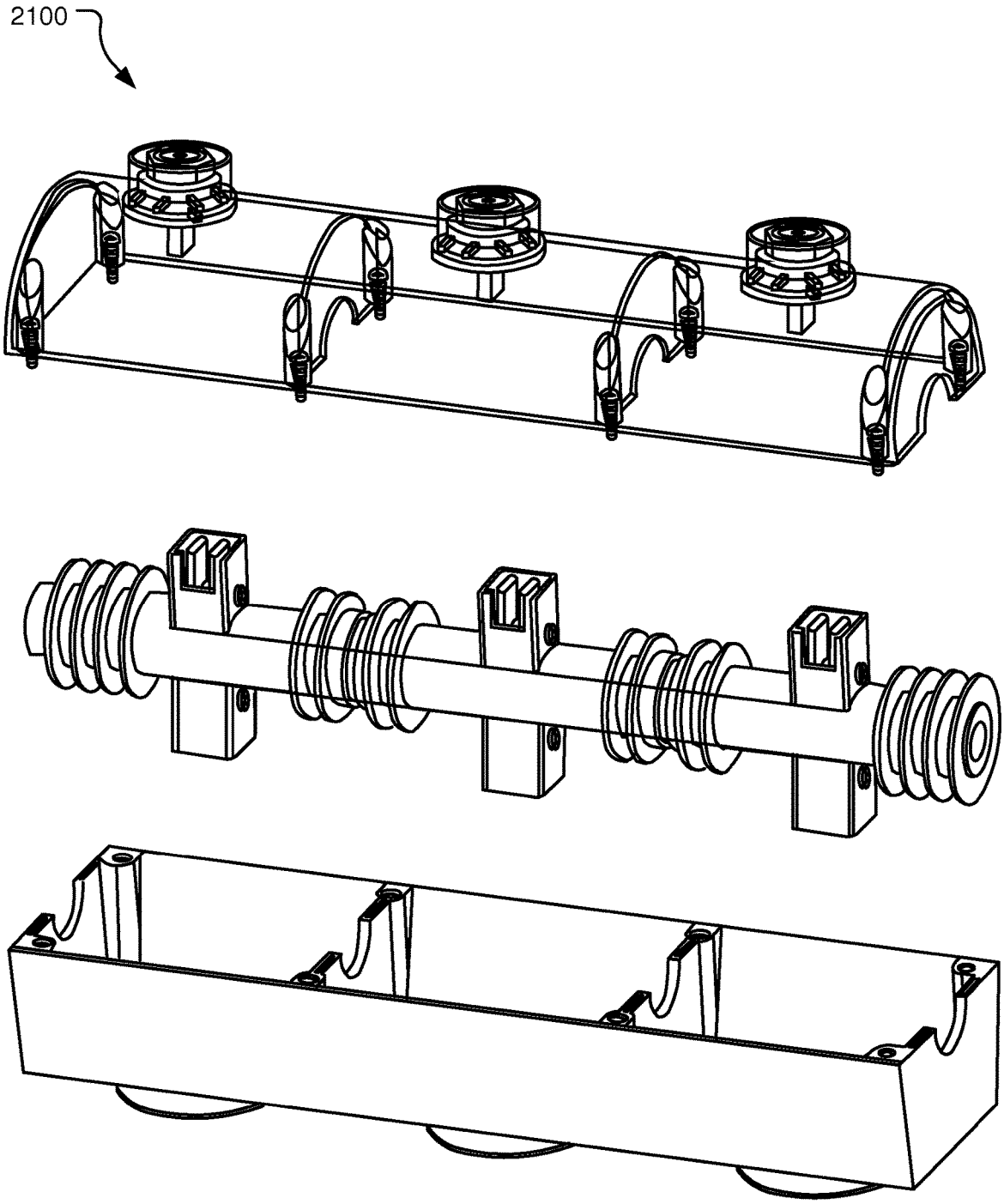
FIG. 21 illustrates an exploded view of a base and cover assembly for an insulated compartment.
Figure 22A:
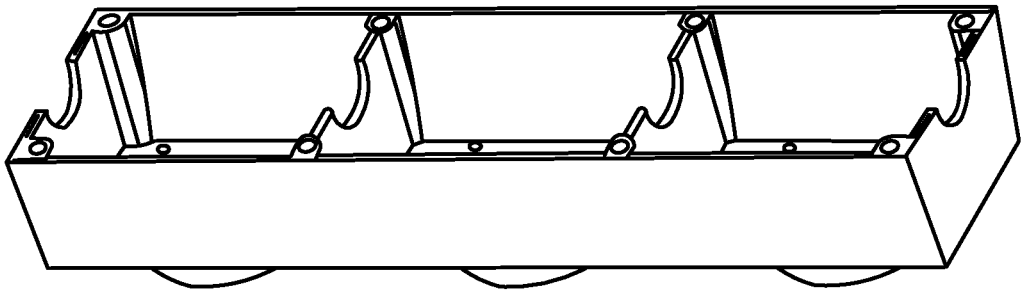
FIG. 22A illustrates a three-dimensional view of a base for an insulated compartment, in accordance with one embodiment.
Figure 22B:
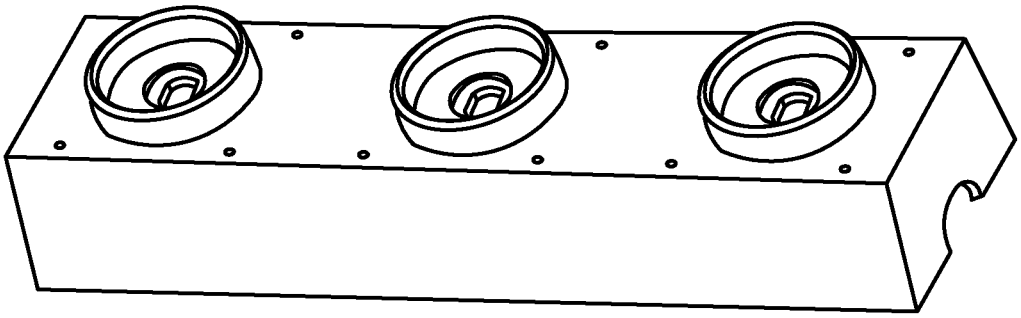
FIG. 22B illustrates a three-dimensional view from above of a base for an insulated compartment, in accordance with one embodiment.
Figure 22C:
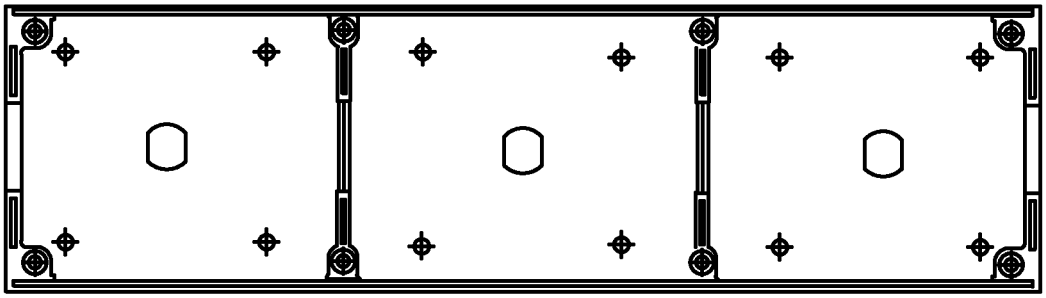
FIG. 22C illustrates a top view of a base for an insulated compartment, in accordance with one embodiment.
Figure 22D:
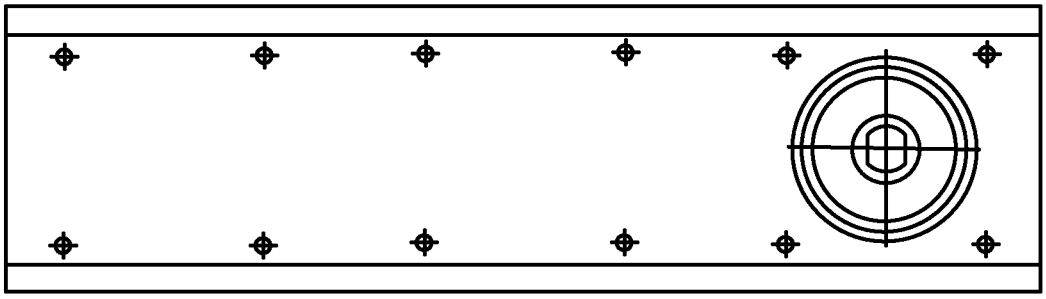
FIG. 22D illustrates a bottom view of a base for an insulated compartment, in accordance with one embodiment.
Figure 23A:
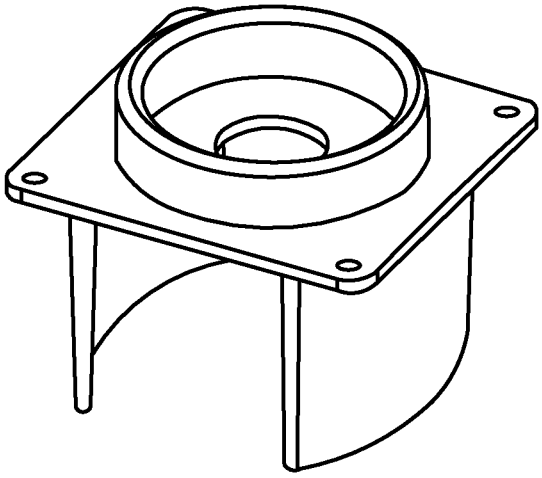
FIG. 23A illustrates a three-dimensional view of a support piece for an interrupter, in accordance with one embodiment.
Figure 23B:
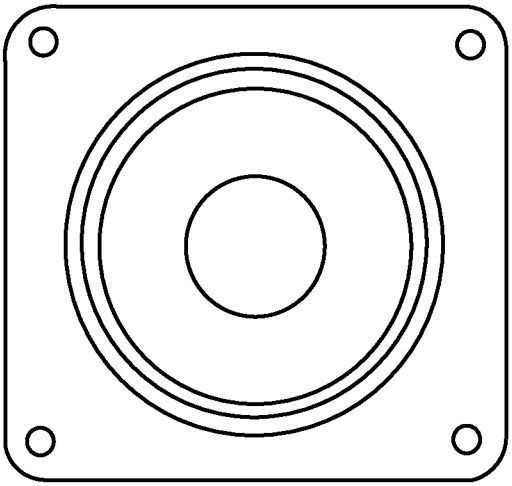
FIG. 23B illustrates a top view of a support piece for an interrupter in accordance with one embodiment.
Figure 23C:
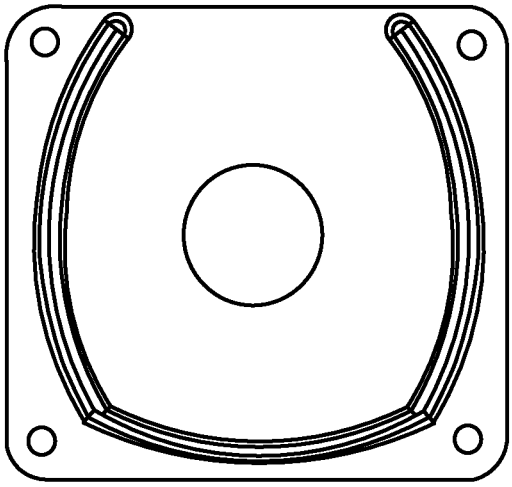
FIG. 23C illustrates a bottom view of a support piece for an interrupter, in accordance with one embodiment.

Additional views of some examples of the structural pieces discussed herein are shown in the figures to provide further illustration. FIG. 21 illustrates an exploded view of a base and cover assembly for an insulated compartment. FIG. 22A illustrates a three-dimensional view of a base for an insulated compartment, in accordance with one embodiment. FIG. 22B illustrates a three-dimensional view from above of a base for an insulated compartment, in accordance with one embodiment. FIG. 22C illustrates a top view of a base for an insulated compartment, in accordance with one embodiment. FIG. 22D illustrates a bottom view of a base for an insulated compartment, in accordance with one embodiment. FIG. 23A illustrates a three-dimensional view of a support piece for an interrupter, in accordance with one embodiment. FIG. 23B illustrates a top view of a support piece for an interrupter in accordance with one embodiment. FIG. 23C illustrates a bottom view of a support piece for an interrupter, in accordance with one embodiment.

In some of the examples described herein a three-phase switching mechanism has been used as the example. It should be appreciated that the technology described herein can apply to not only multi-phase devices, but also, single-phase devices.

It some of the examples described herein a switching mechanism that utilizes a visual open isolation point is used as the example. It should be appreciated that a visual open isolation point is not required by all embodiments. In some instances, disclosed features could be implemented on devices that do not utilize visual open isolation points.

In some of the examples described herein an interrupter having an integral terminal configured for serving as part of a switch terminal, such as a stab terminal, is described. It should be appreciated that such a terminal is not required by all embodiments.

The above specification, examples, and data provide a complete description of the structure and use of exemplary embodiments. Feature(s) of the different embodiment(s) may be combined in yet another embodiment without departing from the recited claims.

What is claimed is:

1. An apparatus comprising:

a switching mechanism rated to operate at voltages between 4,000 volts and 35,000 volts and comprising:

a metallic housing to house the switching mechanism;

an isolation point assembly of the switching mechanism located within the metallic housing and visible from outside the metallic housing to visibly exhibit a physical open-circuit by the switching mechanism;

a vacuum interrupter of the switching mechanism electrically coupled in series with a phase-switch of the isolation point assembly; and a base that holds the isolation point assembly, wherein the base is within the metallic housing, the base comprises an electrically insulating material and an opening through which an electrical terminal of the vacuum interrupter passes, and the base is between the vacuum interrupter and the isolation point assembly, wherein the isolation point assembly is electrically insulated without using $SF_6$ gas during operation; and the apparatus further comprises an actuator, the actuator comprising:

a first drive mechanism coupled to the vacuum interrupter of the switching mechanism;

a second drive mechanism coupled to the phase-switch of the isolation point assembly;

a linkage assembly coupled to the first drive mechanism and the second drive mechanism; and a single operating handle coupled to the linkage assembly.

2. The apparatus as claimed in claim 1 wherein the metallic housing that the vacuum interrupter and the phase-switch are disposed in is an air-filled metallic housing.

3. The apparatus as claimed in claim 1 wherein the phase-switch is disposed in an insulated environment comprising substantially no sulfur.

4. The apparatus as claimed in claim 1 wherein the isolation point assembly comprises:

a multi-blade contact to electrically couple with the electrical terminal of the vacuum interrupter in a closed-circuit position and to electrically de-couple from the electrical terminal of the vacuum interrupter in an open-circuit position, and wherein the phase-switch comprises the multi-blade contact.

5. The apparatus as claimed in claim 1 wherein the isolation point assembly comprises:

a shaft comprising: a body that extends along a shaft axis, the body being configured to rotate about the shaft axis;

a first contact on an exterior surface of the body, the first contact for electrically engaging a terminal contact when the isolation point assembly is in a closed-circuit position; and a second contact on the exterior surface of the body, the second contact for electrically engaging the electrical terminal of the vacuum interrupter when the isolation point assembly is in the closed-circuit position, wherein the phase-switch comprises the first contact and the second contact.

6. The apparatus as claimed in claim 1 wherein the metallic housing is a hermetically sealed container.

7. The apparatus as claimed in claim 1 wherein an operational volume for the switching mechanism in an open-circuit position is substantially the same as an operational volume for the switching mechanism in a closed-circuit position.

8. The apparatus as claimed in claim 1 wherein operational clearances for the switching mechanism in an open-circuit position are substantially the same as operational clearances for the switching mechanism in a closed-circuit position.

9. The apparatus as claimed in claim 1 wherein the switching mechanism is configured to provide alternative operating positions of open circuit, closed circuit, and tripped open while incoming and outgoing electrical cables are electrically coupled with the switching mechanism.

10. The apparatus as claimed in claim 1 wherein the switching mechanism is electrically insulated using only air and solid dielectric materials.

11. The apparatus as claimed in claim 1 wherein the vacuum interrupter is a non-solid dielectric-encapsulated vacuum interrupter.

12. The apparatus as claimed in claim 1 wherein the base further comprises a substantially transparent cover coupled to the electrically insulating material, and wherein the phase-switch is enclosed in a space defined by the substantially transparent cover and the electrically insulating material.

13. An apparatus comprising:

a switching mechanism rated to operate at voltages between 4,000 voltages and 35,000 volts and comprising:

a metallic housing to house the switching mechanism;

an isolation point assembly of the switching mechanism located within the metallic housing and visible from outside the metallic housing to visibly exhibit a physical open-circuit by the switching mechanism;

at least three phases of the switching mechanism, each phase comprising a phase-switch of the isolation point assembly in series with a respective vacuum interrupter; and a base that holds the isolation point assembly, wherein the base is within the metallic housing, the base comprises an electrically insulating material and a plurality of openings, wherein an electrical terminal of each of the vacuum interrupters passes through one of the plurality of openings, and the base is between the vacuum interrupters and the isolation point assembly, wherein the isolation point assembly is electrically insulated without using $SF_6$ gas during operation; and the apparatus further comprises an actuator, the actuator comprising:

a first drive mechanism coupled to the vacuum interrupters;

a second drive mechanism coupled to the phase-switches of the isolation point assembly;

a single linkage assembly coupled to the first drive mechanism and the second drive mechanism; and a single operating handle coupled to the linkage assembly, wherein moving the single operating handle through a range of motion opens or closes the phase-switches and the vacuum interrupters.

14. The apparatus as claimed in claim 13 wherein each of the one or more phase-switches is disposed in an air-filled compartment distinct from other compartments for each of the other respective phase-switches.

15. The apparatus as claimed in claim 13 and wherein at least one of the vacuum interrupters is positioned along a longitudinal axis when the at least one vacuum interrupter is in an open-circuit position and in a closed-circuit position.

16. The apparatus as claimed in claim 13 wherein the phase-switches are rated for fault current and wherein the vacuum interrupters are rated for interrupting current.

17. The apparatus as claimed in claim 13 wherein each respective vacuum interrupter is a non-solid dielectric-encapsulated vacuum interrupter.

18. The apparatus as claimed in claim 13 wherein the actuator is configured to open each vacuum interrupter in the at least three phases prior to opening each of the phase-switches in the at least three phases.

19. The apparatus as claimed in claim 18 wherein the first drive mechanism is coupled with each of the vacuum interrupters, and the second drive mechanism is coupled with each of the phase-switches so as to open each vacuum interrupter in the at least three phases before opening each of the phase-switches in the at least three phases.

20. The apparatus as claimed in claim 19 wherein the actuator provides a pre-determined time-delay between opening of the vacuum interrupters and opening of the phase-switches.

21. The apparatus as claimed in claim 19 wherein the actuator is configured so as to close the phase-switches before closing the vacuum interrupters.

22. The apparatus as claimed in claim 19 wherein the single handle is configured to open the vacuum interrupters and the phase-switches during a single movement.

23. The apparatus as claimed in claim 19 wherein the single handle is configured to close the phase-switches and the vacuum interrupters during a single movement.

24. A method comprising:

installing a switching mechanism rated to operate at voltages between 4,000 volts and 35,000 volts;

moving a single operating handle through a range of motion to thereby actuate the switching mechanism; and observing through a metallic housing for the switching mechanism an isolation point assembly of the switching mechanism, the isolation point assembly visible from outside the metallic housing to visibly exhibit a physical open-circuit by the switching mechanism when the switching mechanism is open;

wherein a phase-switch of the isolation point assembly is electrically coupled in series with a vacuum interrupter of the switching mechanism;

wherein a base comprising an electrically insulating material and an opening through which an electrical terminal of the vacuum interrupter passes holds the isolation point assembly, the base is between the vacuum interrupter and the isolation point assembly, and wherein the isolation point assembly is electrically insulated without using $SF_6$ gas during operation.

25. The method as claimed in claim 24 wherein the phase-switches are disposed in an air-filled metallic housing.

26. The method as claimed in claim 25 wherein each phase-switch is disposed in an air-filled compartment distinct from each of the other phase-switches.

27. The method as claimed in claim 24 wherein the phase-switches are disposed in an insulated environment comprising substantially no sulfur.

28. The method as claimed in claim 24 and wherein moving the single operating handle through the range of motion opens the switching mechanism, and comprises:

operating the vacuum interrupter along a fixed longitudinal axis so that the vacuum interrupter is positioned along the longitudinal axis when the vacuum interrupter is in an open-circuit position and when the vacuum interrupter is in a closed-circuit position.

29. The method as claimed in claim 24 and wherein moving the operating handle through the range of motion to actuate the switching mechanism further comprises:

engaging a multi-blade contact with the electrical contact of the vacuum interrupter for a closed-circuit position; and disengaging the multi-blade contact from the electrical contact of the vacuum interrupter for an open-circuit position.

30. The method as claimed in claim 24 wherein moving the single operating handle along the range of motion to actuate the switching mechanism comprises driving a linkage that is coupled the single operating handle and is also coupled to a first drive mechanism and a second drive mechanism, the first drive mechanism is coupled to the vacuum interrupter and the second drive mechanism is coupled to the phase-switch, and driving the linkage cause the second drive mechanism to cause a switching operation by rotating a shaft about a shaft axis, wherein the shaft comprises:

a body that extends along the shaft axis;

a first contact on an exterior of the body, the first contact for electrically engaging a terminal contact when the isolation point assembly is in a closed-circuit position; and a second contact on the exterior of the body, the second contact for electrically engaging an interrupter contact when the isolation point assembly is in the closed-circuit position.

31. The method as claimed in claim 24 wherein the metallic housing is a hermetically sealed container.

32. The method as claimed in claim 24 wherein an operational volume for the switching mechanism in an open-circuit position is substantially the same as an operational volume for the switching mechanism in a closed-circuit position.

33. The method as claimed in claim 24 wherein operational clearances for the switching mechanism in an open-circuit position are substantially the same as operational clearances for the switching mechanism in a closed-circuit position.

34. The method as claimed in claim 24 wherein the vacuum interrupter is a non-solid dielectric-encapsulated vacuum interrupter.

35. A method comprising:

installing a switching mechanism rated to operate at voltages between 4,000 volts and 35,000 volts;

moving a single operating handle through a range of motion to thereby actuate the switching mechanism;

observing through a metallic housing for the switching mechanism an isolation point assembly of the switching mechanism, the isolation point assembly visible from outside the metallic housing to visibly exhibit a physical open-circuit by the switching mechanism when the switching mechanism is open; and utilizing at least three phases for the switching mechanism, each phase comprising a phase-switch in series with a respective vacuum interrupter, wherein a base comprising an electrically insulating material and an opening through which an electrical terminal of each of the vacuum interrupters passes holds the isolation point assembly, the base is between the vacuum interrupters and the isolation point assembly, and the isolation point assembly is electrically insulated without using $SF_6$ gas during operation.

36. The method as claimed in claim 35 and further comprising:

utilizing phase-switches rated for fault current; and utilizing vacuum interrupters rated for interrupting current.

37. The method as claimed in claim 35 wherein each respective vacuum interrupter is a non-solid dielectric-encapsulated vacuum interrupter.

38. The method as claimed in claim 35 wherein moving the single operating handle through the range of motion actuates the switching mechanism so as to open the switching apparatus, and wherein opening the switching apparatus comprises opening the vacuum interrupters in the at least three phases prior to opening the phase-switches in the at least three phases.

39. The method as claimed in claim 38 wherein moving the single operating handle through the range of motion actuates the switching mechanism so as to close the switching assembly, and wherein closing the switching assembly comprises closing the phase-switches in the at least three phases before closing the vacuum interrupters in the at least three phases.

40. The method as claimed in claim 39 and wherein moving the single operating handle through the range of motion further comprises:

actuating the switching mechanism so as to provide a pre-determined time-delay between opening of the vacuum interrupters and opening of the phase-switches.

41. The method as claimed in claim 39 and wherein moving the single operating handle through the range of motion further comprises:

actuating the switching mechanism so as to close the phase-switches before closing the vacuum interrupters.

42. The method as claimed in claim 39 wherein the vacuum interrupters and the phase-switches are opened during a single movement of the single operating handle.

43. The method as claimed in claim 39 wherein the phase-switches and the vacuum interrupters are closed during a single movement of the single operating handle.

* * * * *